US010400992B2

(12) United States Patent
Kim

(10) Patent No.: US 10,400,992 B2
(45) Date of Patent: Sep. 3, 2019

(54) LIGHTING APPARATUS HAVING DIFFERENT REFLECTION SHEETS

(71) Applicant: LG INNOTEK CO., LTD., Seoul (KR)

(72) Inventor: Ki Hyun Kim, Seoul (KR)

(73) Assignee: LG Innotek Co., Ltd., Seoul (KR)

( * ) Notice: Subject to any disclaimer, the term of this patent is extended or adjusted under 35 U.S.C. 154(b) by 36 days.

(21) Appl. No.: 15/580,521

(22) PCT Filed: Jun. 8, 2016

(86) PCT No.: PCT/KR2016/006073
§ 371 (c)(1),
(2) Date: Dec. 7, 2017

(87) PCT Pub. No.: WO2016/200149
PCT Pub. Date: Dec. 15, 2016

(65) Prior Publication Data

US 2019/0086057 A1 Mar. 21, 2019

(30) Foreign Application Priority Data

Jun. 9, 2015 (KR) ..... 10-2015-0081381

(51) Int. Cl.
*F21V 7/04* (2006.01)
*F21V 29/50* (2015.01)
(Continued)

(52) U.S. Cl.
CPC ..... *F21V 7/22* (2013.01); *F21K 9/62* (2016.08); *F21V 7/005* (2013.01); *F21V 7/0008* (2013.01);
(Continued)

(58) Field of Classification Search
CPC ..... F21V 7/22; F21V 29/70; F21K 9/62
See application file for complete search history.

(56) References Cited

U.S. PATENT DOCUMENTS 7,960,872 B1 * 6/2011 Zhai ..... F21V 7/0008 307/151
2015/0138829 A1 5/2015 Jang

FOREIGN PATENT DOCUMENTS

CA 2 931 358 A1 5/2015
JP 2011-44348 A 3/2011
(Continued)

*Primary Examiner* — Karabi Guharay
(74) *Attorney, Agent, or Firm* — Birch, Stewart, Kolasch & Birch, LLP

(57) ABSTRACT

According to an embodiment, there is provided a lighting apparatus including: a housing that has a first back cover having a parabolic shape and a recess opened below the first back cover; a first light emitting module that has a circuit board and a plurality of light emitting diodes arranged on the circuit board; a heat radiation body that is disposed in one region of the first back cover and has a first heat radiation portion in which the circuit board is disposed and a first reflection portion which extends from the first heat radiation portion along an contour line of an inner sphere surface of the first back cover; a transparent sheet that is disposed in an oblique shape between a high point of the recess of the first back cover and the heat radiation body; a first reflection sheet that is disposed on the heat radiation body and reflects a first side light emitted from the plurality of light emitting diodes to the transparent sheet; and a second reflection sheet that is disposed on an inner surface of the first back cover and reflects a main light emitted from the plurality of light emitting diodes to the transparent sheet, in which the first reflection sheet includes a plurality of reflection surfaces.

19 Claims, 17 Drawing Sheets

(51) Int. Cl.

| | |
|---|---|
| ***F21V 7/22*** | (2018.01) |
| ***F21V 15/01*** | (2006.01) |
| ***F21V 29/70*** | (2015.01) |
| ***F21V 7/00*** | (2006.01) |
| ***F21V 13/02*** | (2006.01) |
| ***F21V 29/505*** | (2015.01) |
| ***F21K 9/62*** | (2016.01) |
| *F21S 8/02* | (2006.01) |
| *F21Y 113/00* | (2016.01) |
| *F21Y 115/10* | (2016.01) |
| *F21Y 113/10* | (2016.01) |
| *F21V 3/06* | (2018.01) |

(52) U.S. Cl.

CPC ..... *F21V 7/048* (2013.01); *F21V 13/02* (2013.01); *F21V 15/01* (2013.01); *F21V 29/505* (2015.01); *F21V 29/70* (2015.01); *F21S 8/026* (2013.01); *F21V 3/0625* (2018.02); *F21Y 2113/00* (2013.01); *F21Y 2113/10* (2016.08); *F21Y 2115/10* (2016.08)

(56) References Cited

FOREIGN PATENT DOCUMENTS

| | | | |
|---|---|---|---|
| KR | 10-1185533 | B1 | 9/2012 |
| KR | 10-2013-0123574 | A | 11/2013 |
| KR | 10-2013-0126009 | A | 11/2013 |
| WO | WO 2015/076625 | A1 | 5/2015 |

* cited by examiner

【Figure 1】
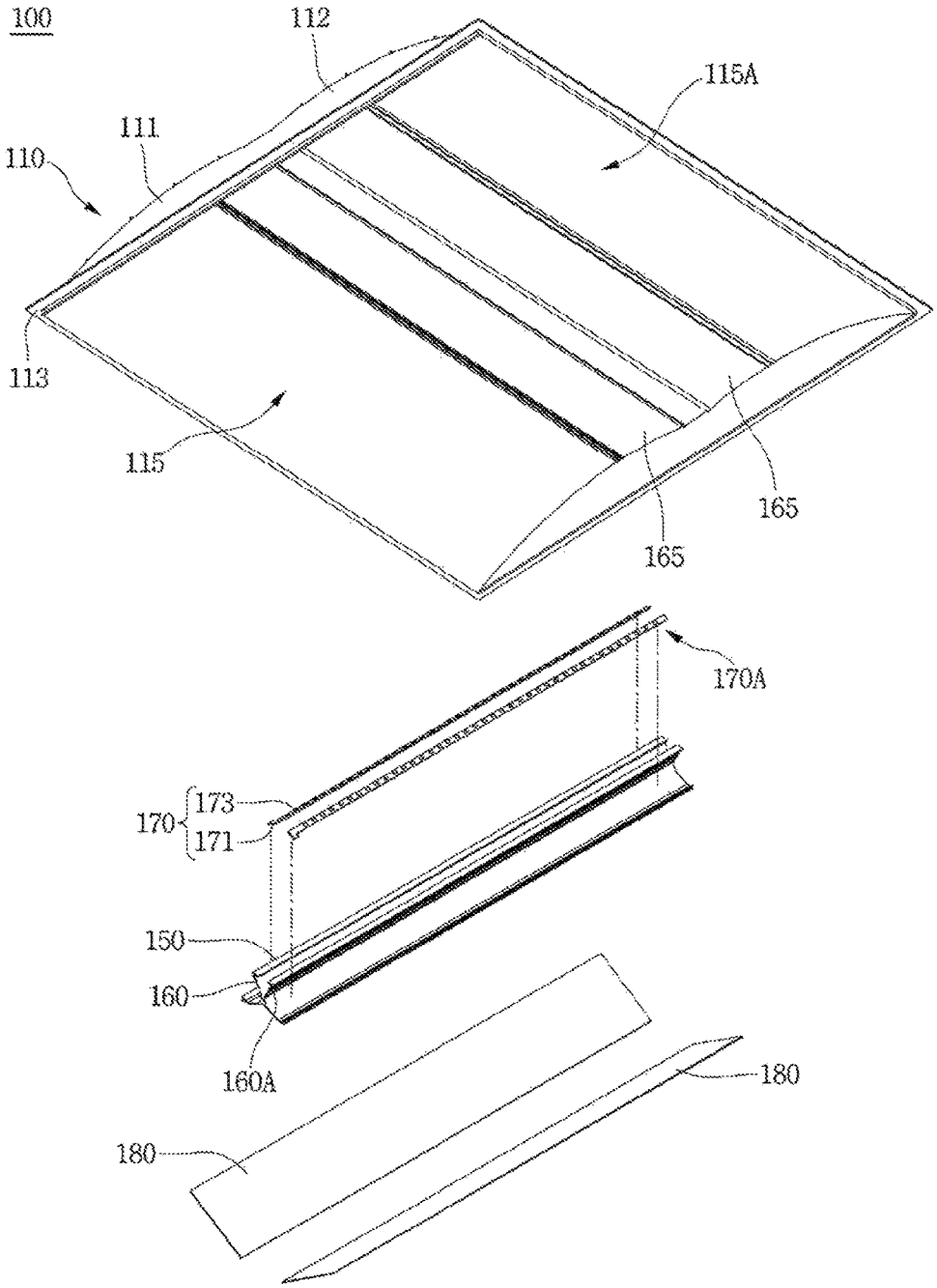

【Figure 2】
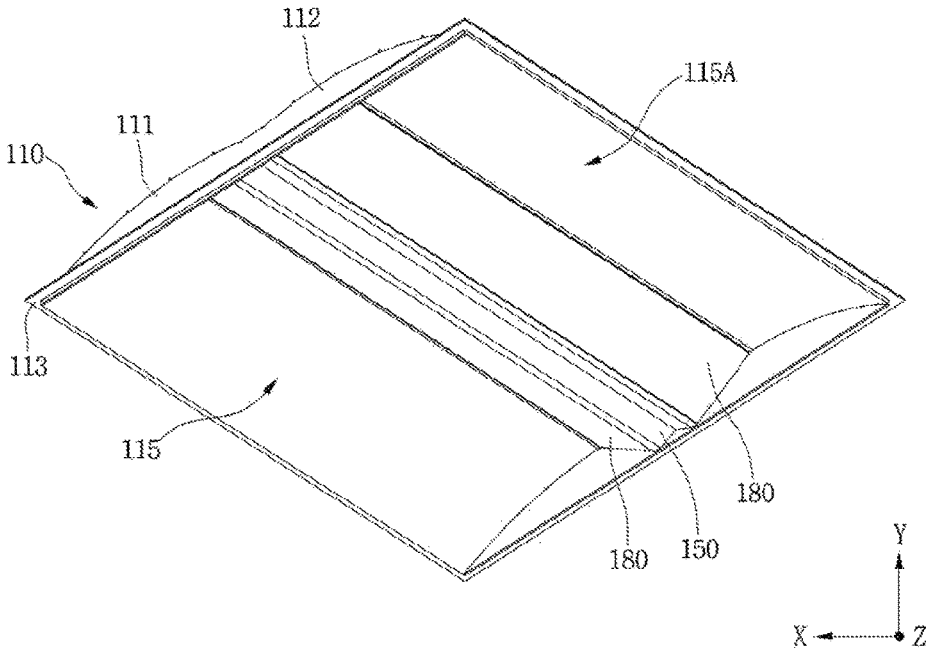

【Figure 3】
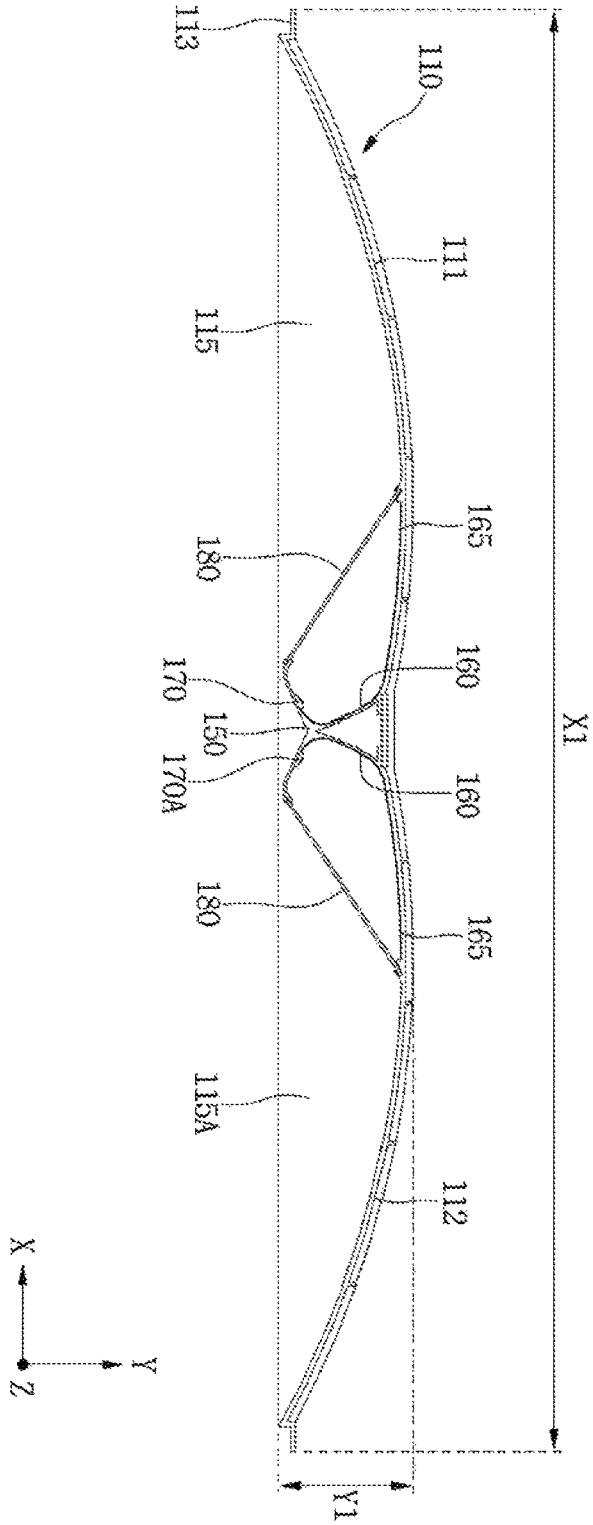

【Figure 4】
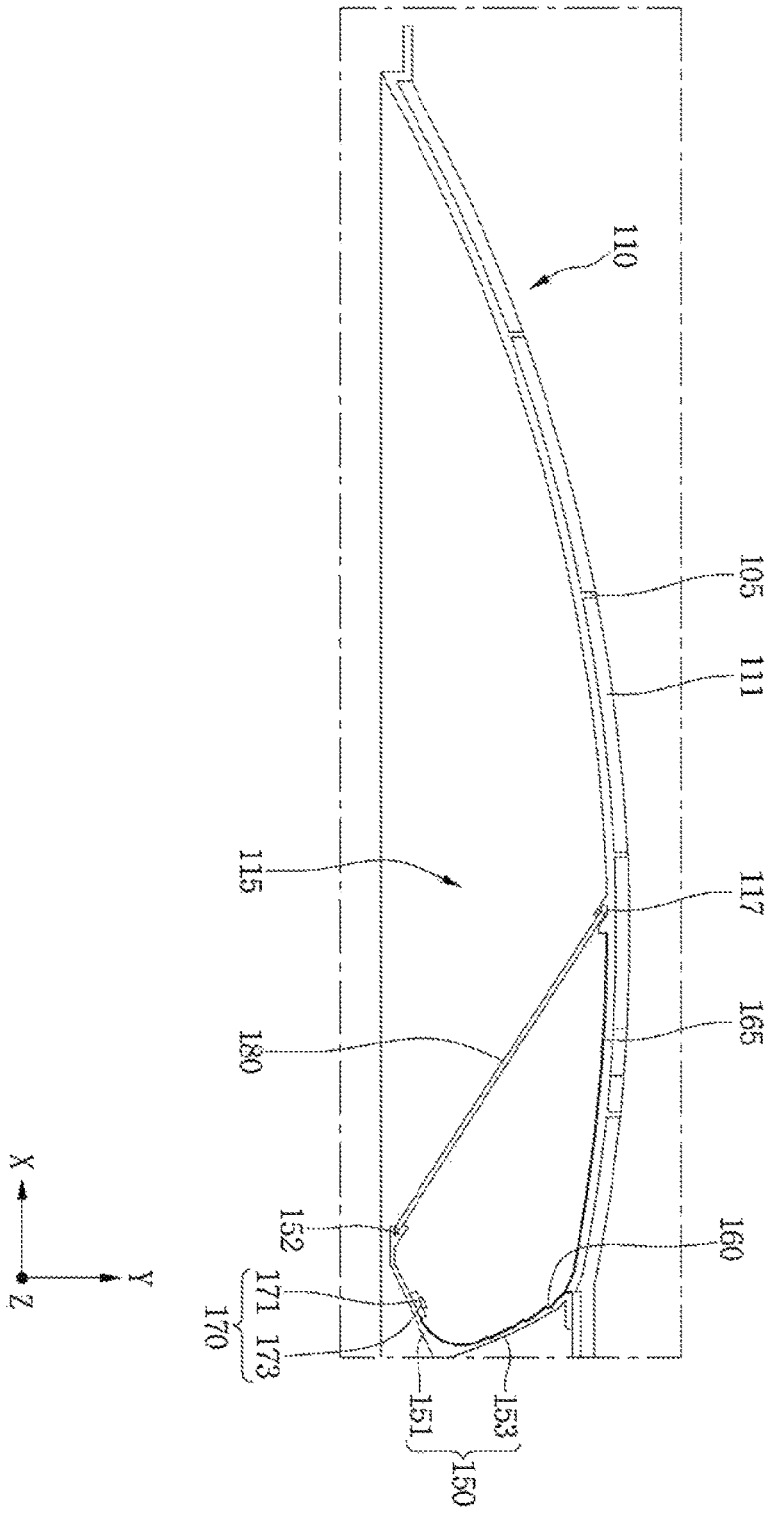

【Figure 5】
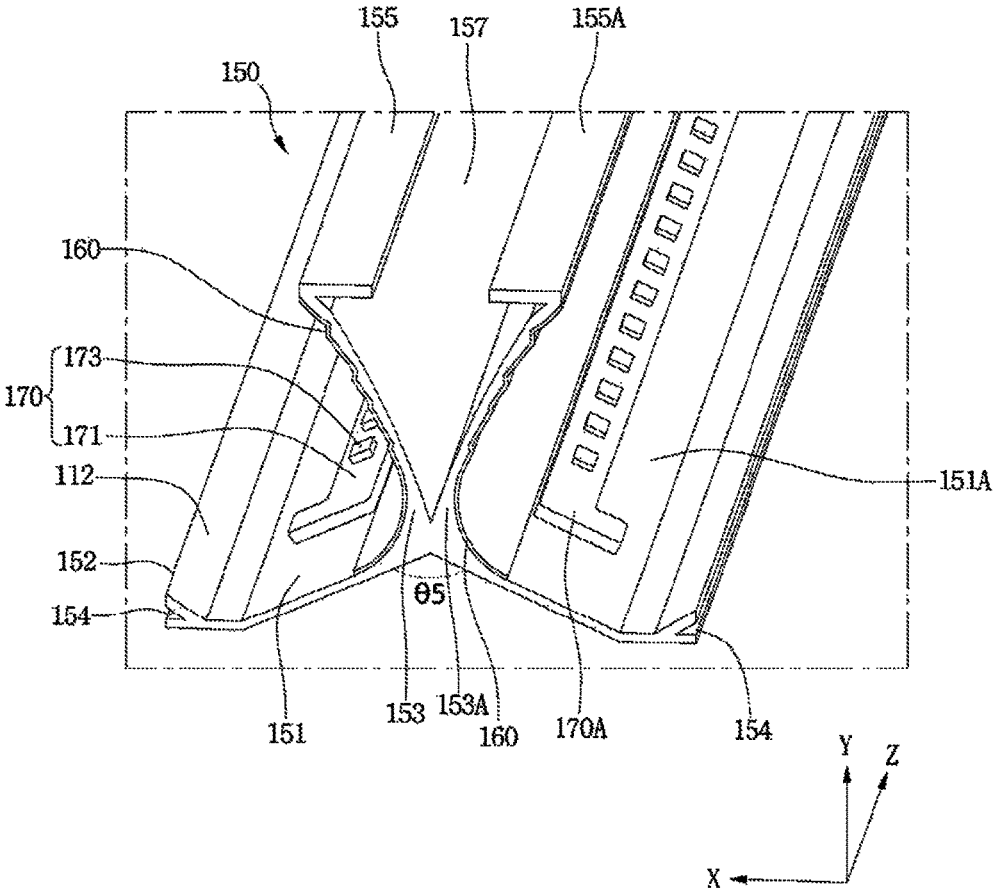

【Figure 6】
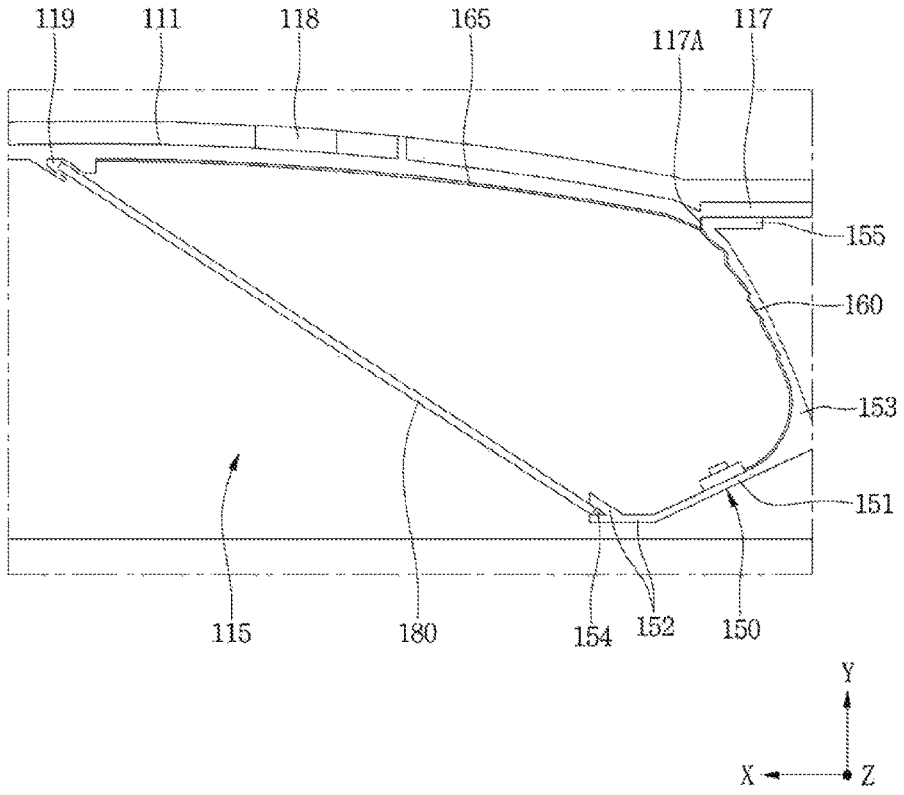

【Figure 7】
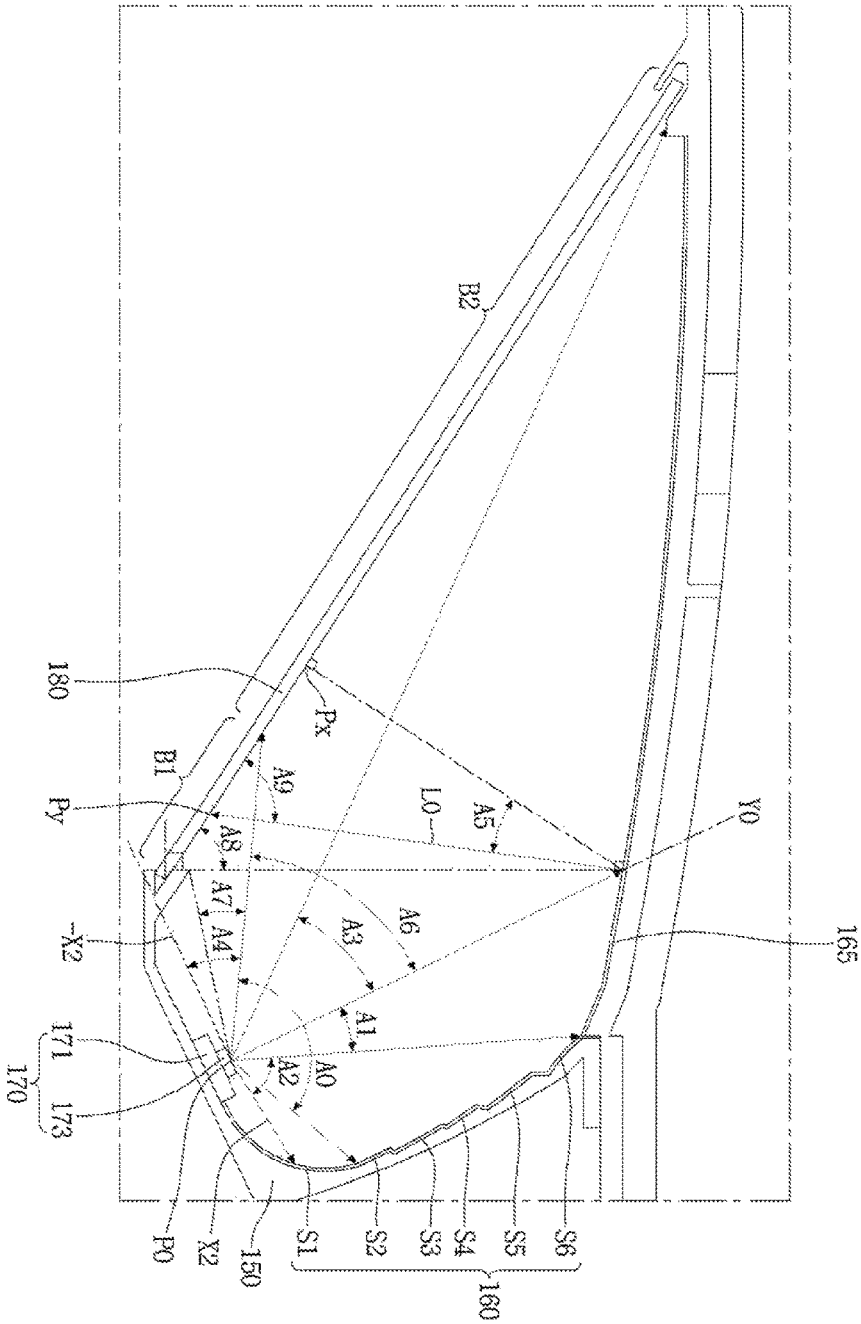

【Figure 8】
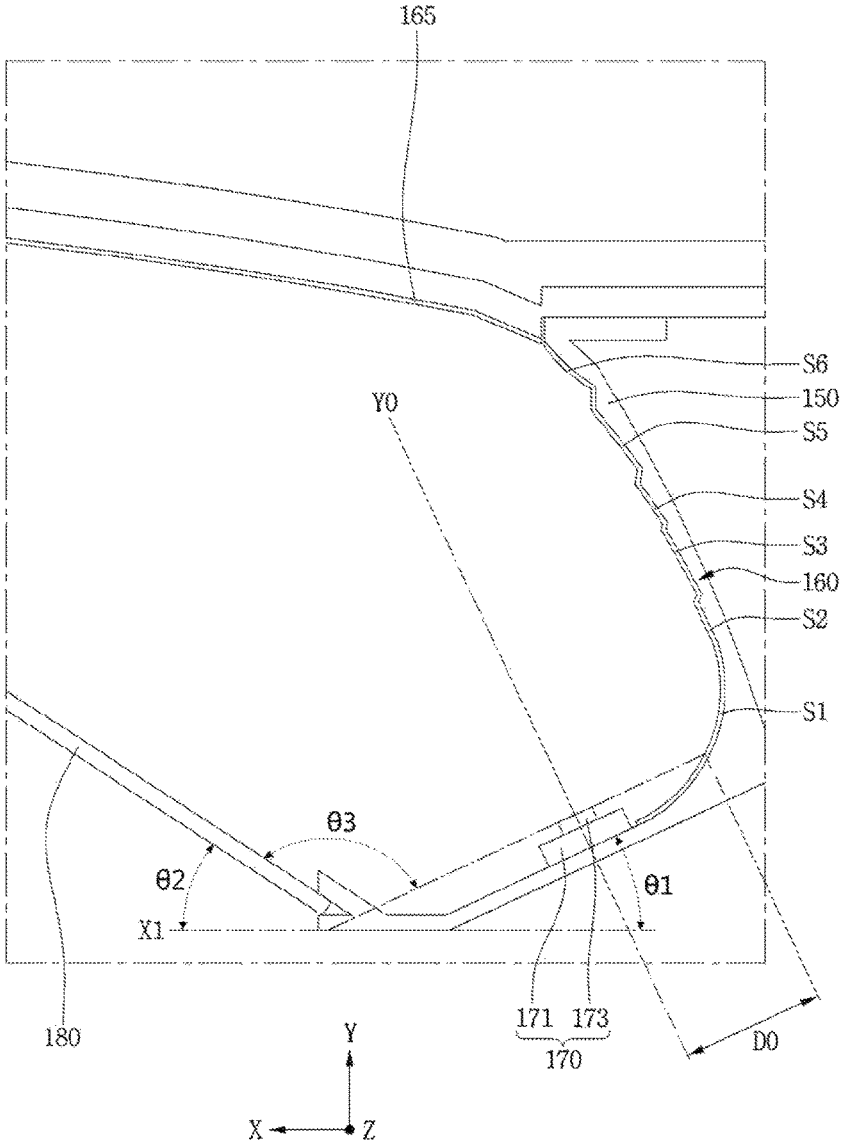

【Figure 9】
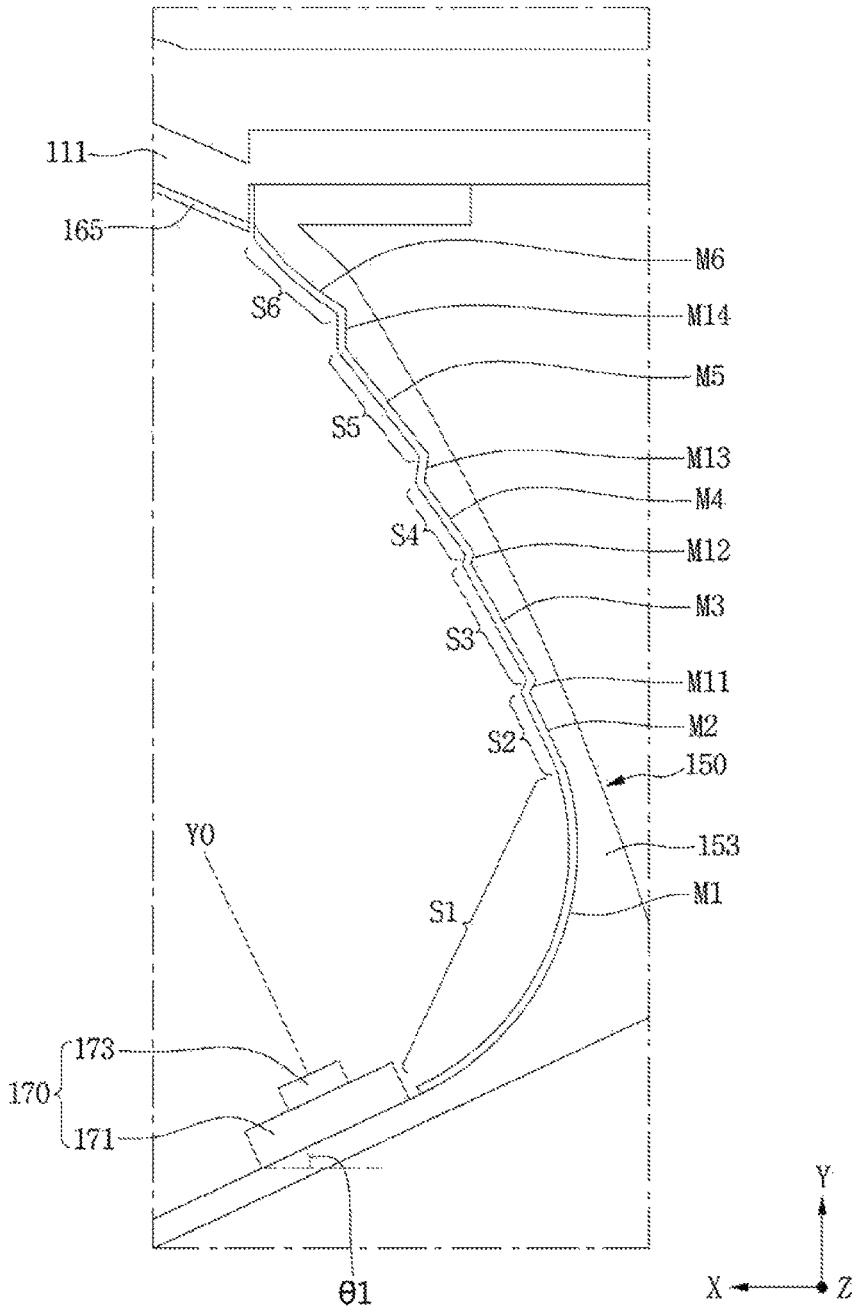

【Figure 10】
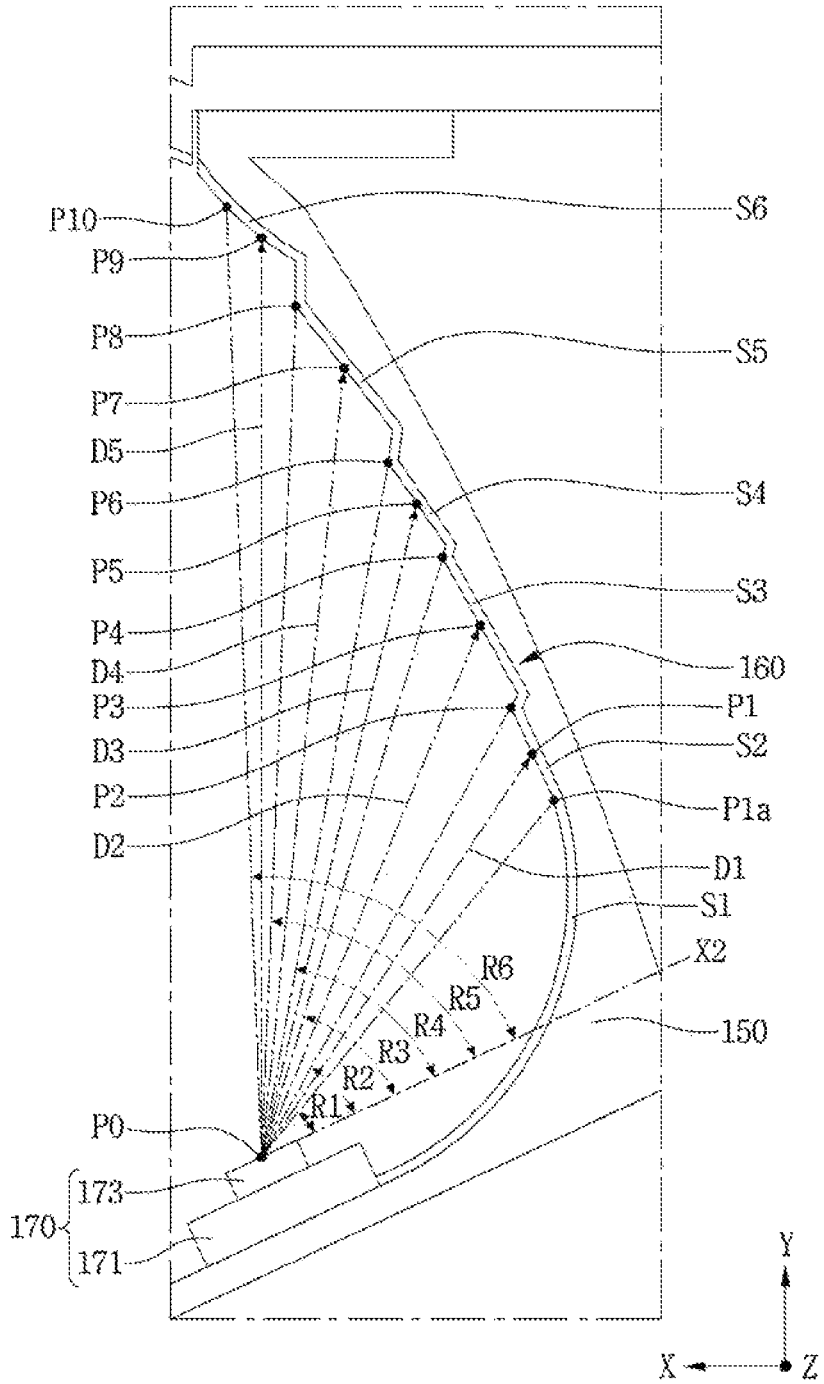

【Figure 11】
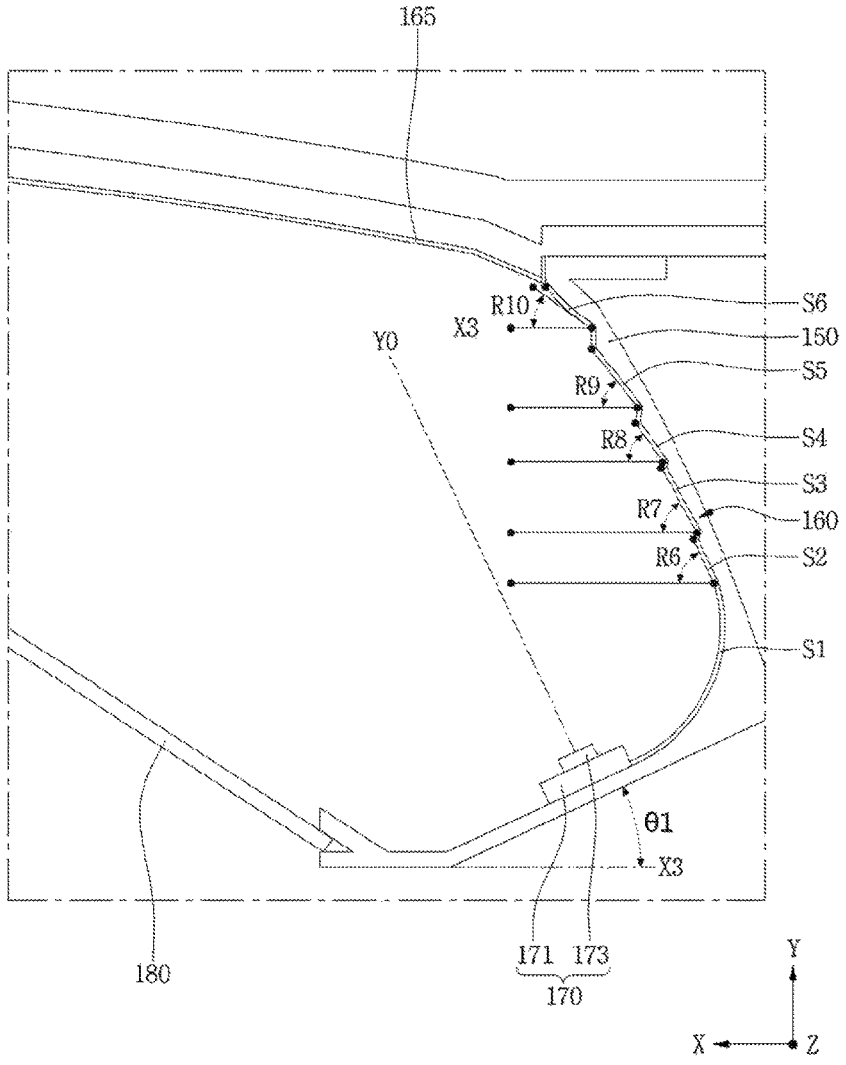

【Figure 12】
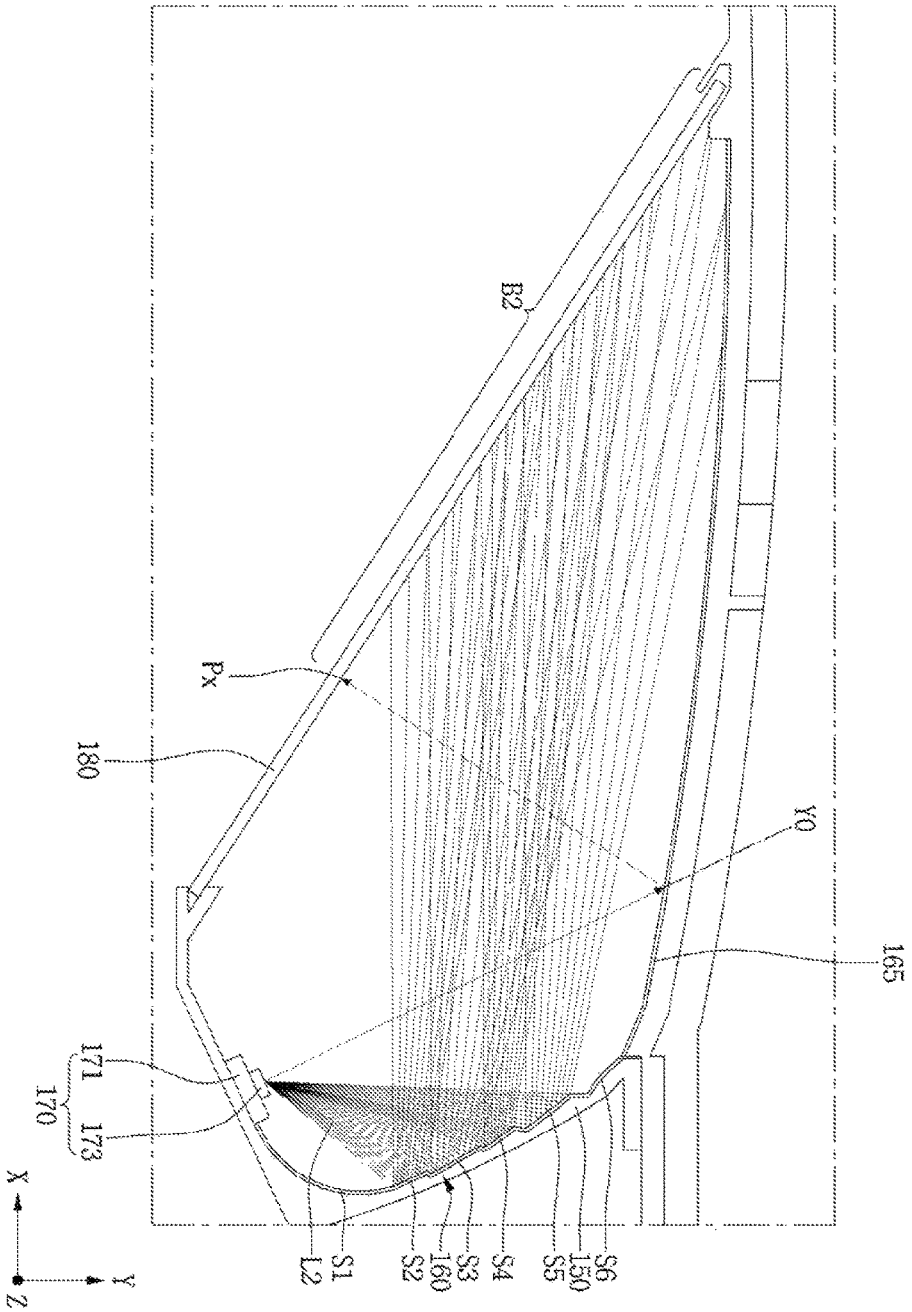

【Figure 13】
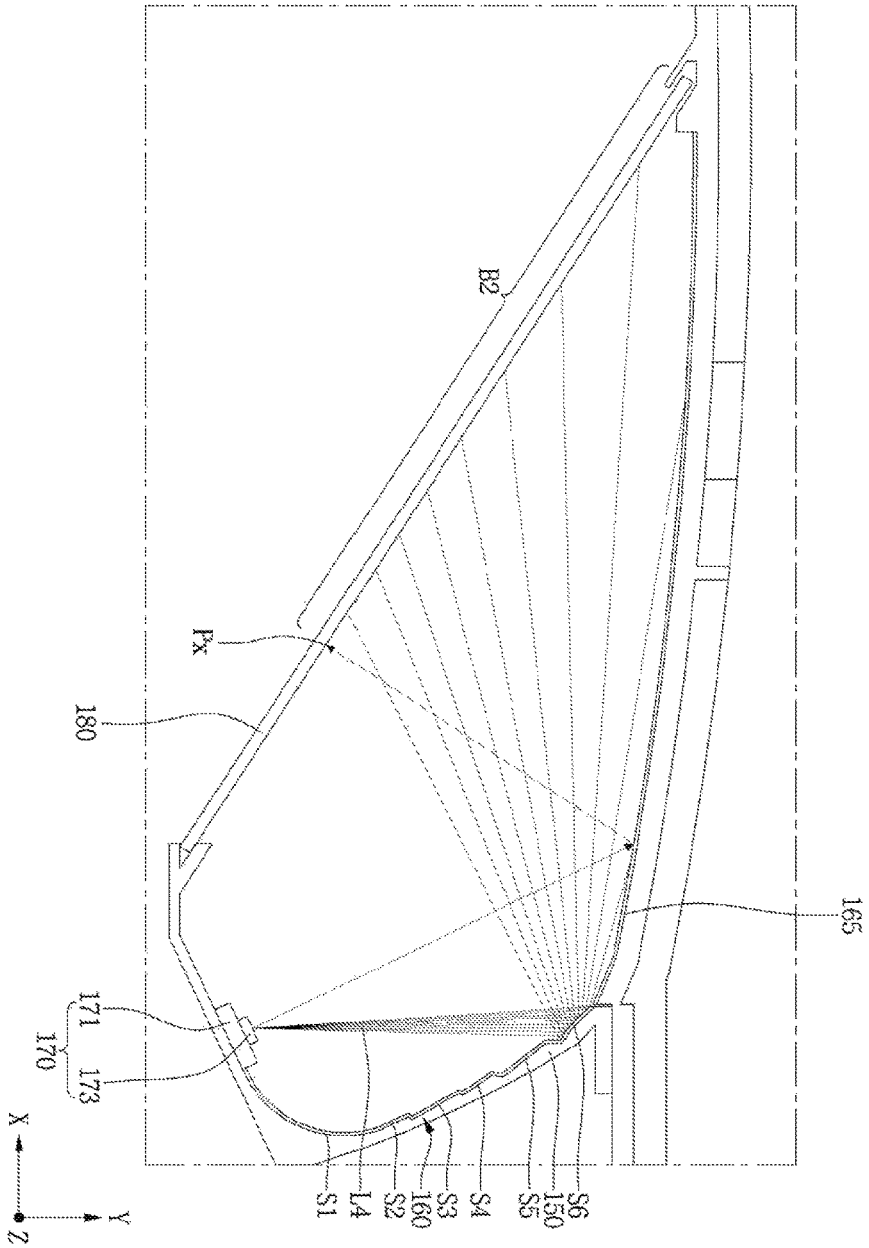

【Figure 14】
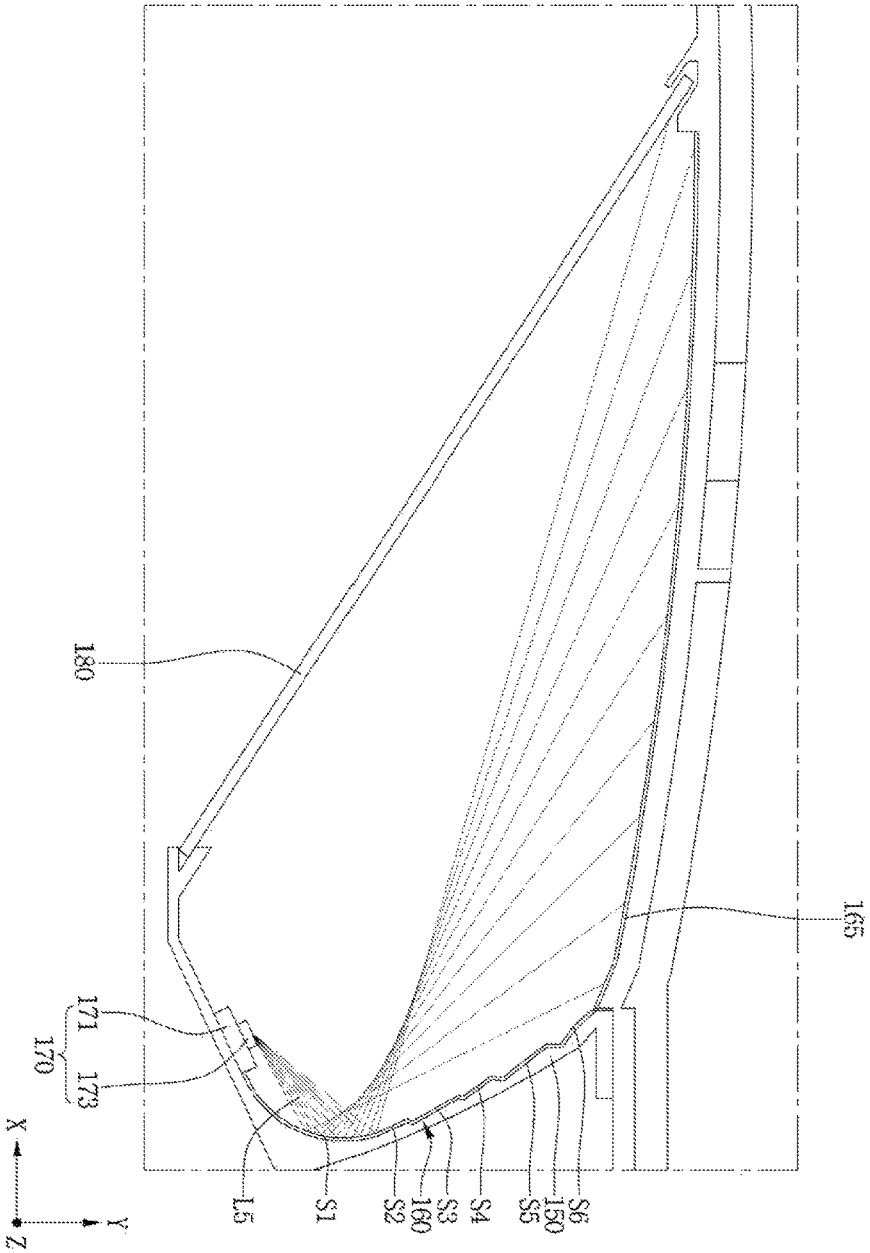

【Figure 15】
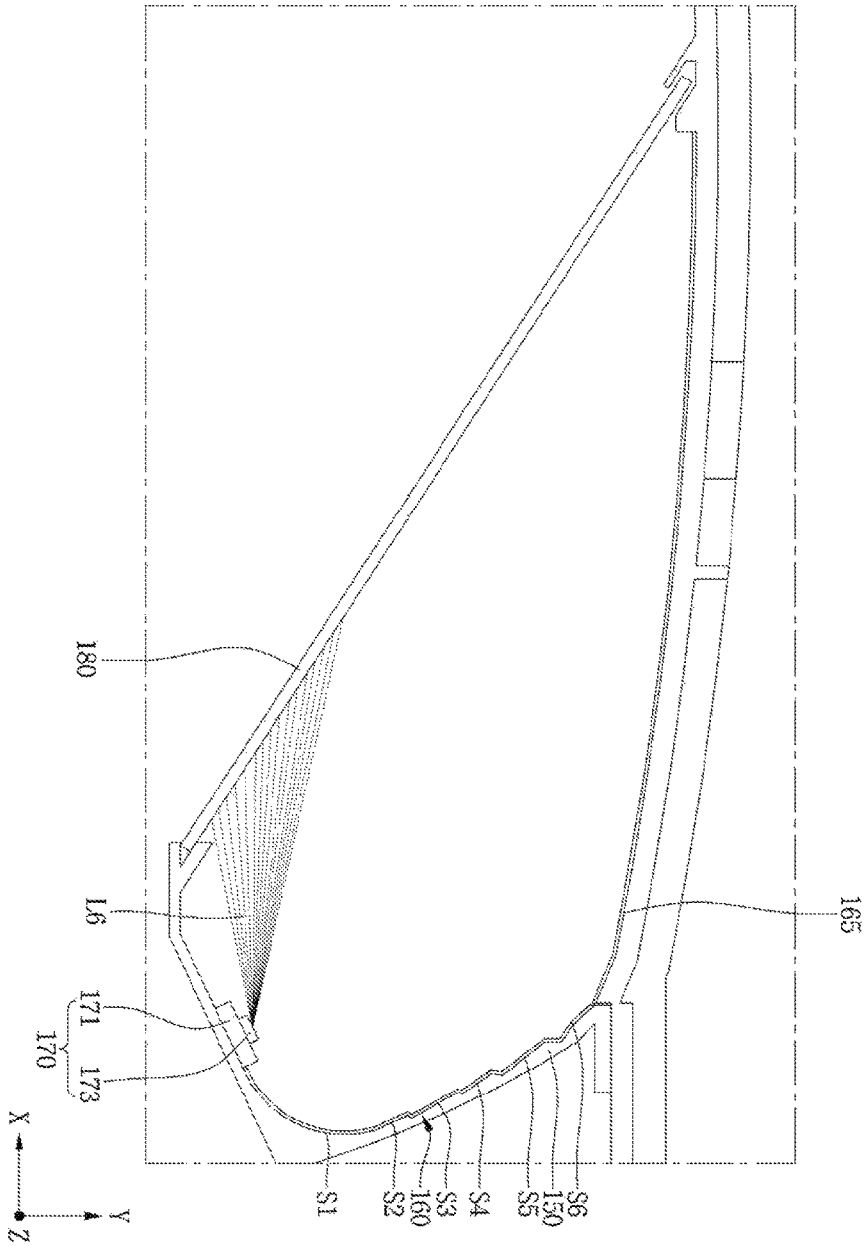

【Figure 16】
(A)
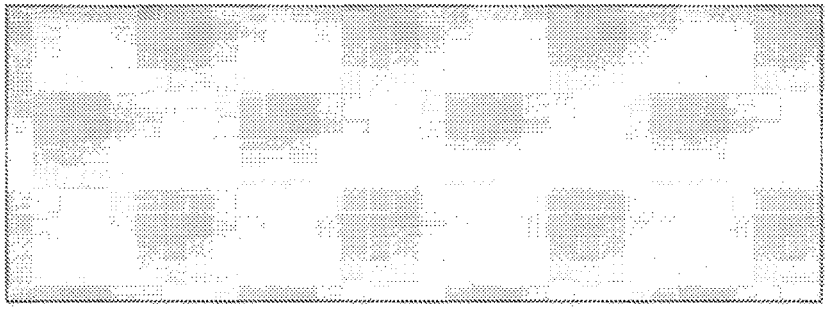
(B)
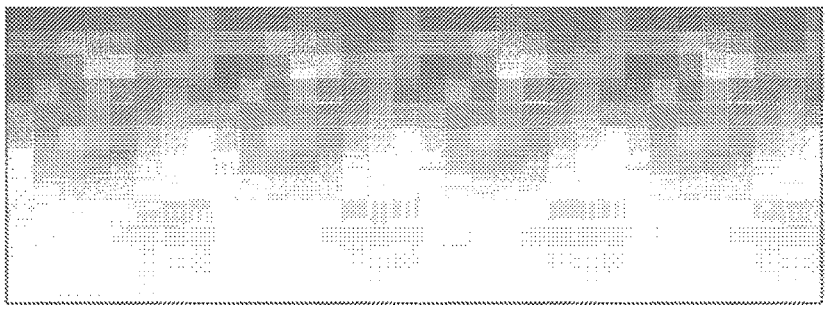
(C)
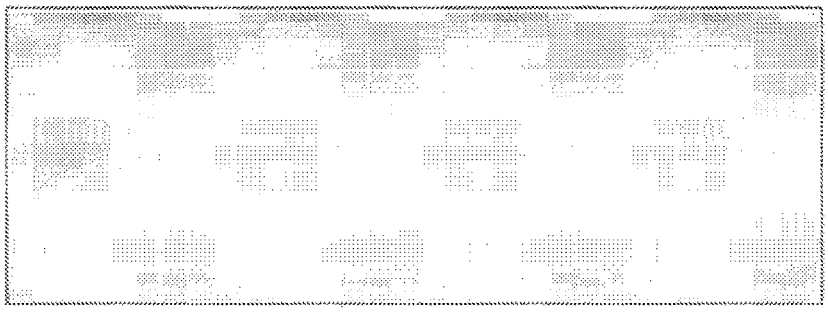

【Figure 17】
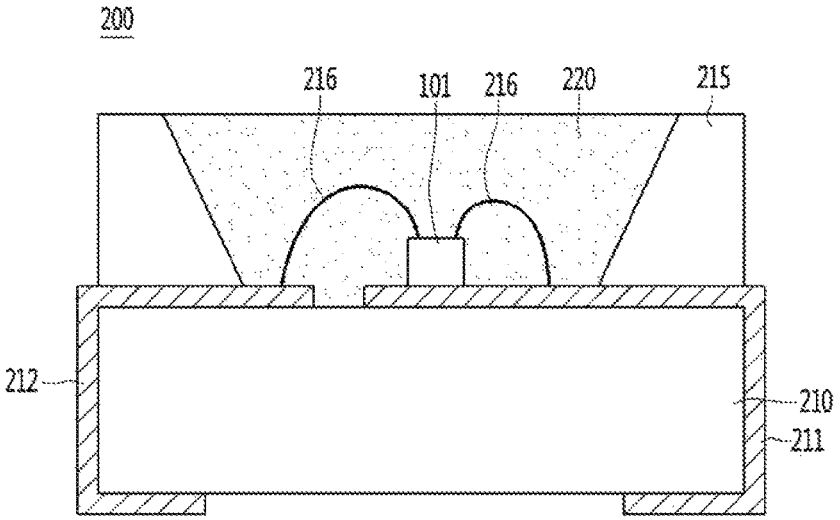

LIGHTING APPARATUS HAVING DIFFERENT REFLECTION SHEETS

CROSS REFERENCE TO RELATED APPLICATIONS

This application is the National Phase of PCT International Application No. PCT/KR2016/006073, filed on Jun. 8, 2016, which claims priority under 35 U.S.C. 119(a) to Patent Application No. 10-2015-0081381, filed in the Republic of Korea on Jun. 9, 2015, all of which are hereby expressly incorporated by reference into the present application.

TECHNICAL FIELD

The embodiment relates to a lighting apparatus.

BACKGROUND ART

In general, a lighting apparatus using a light emitting diode (LED) generates a high heat when turned on. These high heat results in a reduction in the life of various lamps and various components that support the lamps.

In a case where a lighting apparatus using the LED is used, a problem of hot spot may be generated. There is a need for a lighting structure to reduce the problem of such a hot spot and to prevent glare.

DISCLOSURE

Technical Problem

An embodiment provides a flat plate lighting apparatus.

An embodiment provides an indirect lighting apparatus having a light emitting diode.

An embodiment provides a lighting apparatus for preventing glare.

An embodiment provides a lighting module having reflection sheets which are different from each other which reflect a side light and the main light of a plurality of light emitting diodes in an opening portion direction.

An embodiment provides a lighting apparatus for diffusing light irradiated from reflection sheets which are different from each other.

Technical Solution

According to an embodiment, there is provided a lighting apparatus including: a housing that has a first back cover whose inner surface has a parabolic shape and a recess which is opened below the first back cover; a first light emitting module that has a circuit board and a plurality of light emitting diodes which are arranged on the circuit board; a heat radiation body that is disposed in one region of the first back cover and has a first heat radiation portion in which the circuit board is disposed and a first reflection portion which extends from the first heat radiation portion along an contour line of an inner surface of the first back cover; a transparent sheet that is disposed in an oblique shape between a high point of the recess of the first back cover and the heat radiation body; a first reflection sheet that is disposed on the heat radiation body and reflects a first side light emitted from the plurality of light emitting diodes to the transparent sheet; and a second reflection sheet that is disposed on an inner surface of the first back cover and reflects a main light emitted from the plurality of light emitting diodes to the transparent sheet, in which the first reflection sheet includes a plurality of reflection surfaces.

According to another embodiment, there is provided a lighting apparatus including: a housing that has a first back cover and a second back cover which are disposed on both sides of a center thereof and have an inner surface with a parabolic shape and recesses which are opened under the first and second back covers; a first and a second light emitting modules that have a plurality of light emitting diodes for emitting light to the recesses of the first and second back covers and a circuit board on which the light emitting diodes are disposed; a heat radiation body that are disposed below center regions of the first and second back covers and has a plurality of heat radiation portions on which the circuit boards of the first and second light emitting modules are disposed and a plurality of reflection portions which extends along an contour line of an inner spherical surfaces of the first and second back covers from each heat radiation portion; a transparent sheet that is disposed in an oblique shape between a high point of recesses of the first and second back covers and the heat radiation body; a first reflection sheet that is disposed on each reflection portion and reflects a first side light emitted from the plurality of light emitting diodes to the transparent sheet; and second reflection sheets that are disposed on inner surfaces of the first and second back covers and reflects a main light emitted from the plurality of light emitting diodes to the transparent sheet, in which the first reflection sheet has a plurality of reflection surfaces, and in which the first and second back covers has a line-symmetrical shape about a center line.

Advantageous Effects

The embodiment can provide a new flat plate lighting apparatus.

The embodiment can improve the uniformity of light in the lighting apparatus and improve glare.

In the embodiment, the side light of the plurality of light emitting diodes is reflected regions which are different from each other by reflection surfaces of the first reflection sheet which are different from each other, so that a light irradiation region can be uniformly diffused.

The embodiment can improve the reliability of the lighting apparatus.

DESCRIPTION OF DRAWINGS

FIG. 1 is an exploded perspective view of a lighting apparatus according to an embodiment.

FIG. 2 is an assembled perspective view of the lighting apparatus of FIG. 1.

FIG. 3 is a side sectional view of the lighting apparatus of FIG. 2.

FIG. 4 is an enlarged view of a first back cover of the lighting apparatus of FIG. 3.

FIG. 5 is an enlarged view of a light emitting module, a heat radiation body, and a first reflection sheet attached to the light emitting module and the heat radiation body of the lighting apparatus of FIG. 1.

FIG. 6 is a view illustrating first and second reflection sheets and a transparent sheet in the lighting module of FIG. 4.

FIG. 7 is a view for explaining a disposition example of the first and second reflection sheets and the transparent sheet according to an optical path of a light emitting diode in the lighting module of FIG. 4.

FIG. 8 is a view illustrating the heat radiation body and the first reflection sheet of FIG. 4.

FIG. 9 is an enlarged view of FIG. 8.

FIG. 10 is a view comparing the distance and the angle with the center of the first reflection sheet of FIG. 8.

FIG. 11 is a view illustrating the inclination angle of the reflection surfaces of the first reflection sheet of FIG. 8.

FIG. 12 is a view illustrating a reflection path of the center side reflection surfaces of the first reflection sheet of FIG. 8.

FIG. 13 is a view illustrating a reflection path of the outermost reflection surface of the first reflection sheet of FIG. 8.

FIG. 14 is a view illustrating a reflection path of the nearest reflection surface of the first reflection sheet of FIG. 8.

FIG. 15 is a view illustrating a path of side light directly irradiated to the transparent sheet from the light emitting diode of FIG. 8.

FIGS. 16(A), (B), and (C) are diagrams illustrating light distributions in the transparent sheet by the optical paths in FIG. 12, FIG. 13, and FIG. 14.

FIG. 17 is a side sectional view illustrating a light emitting diode according to an embodiment.

BEST MODE

Hereinafter, preferred embodiments of a lighting module or a lighting apparatus having a heat radiation structure according to an embodiment will be described with reference to the accompanying drawings. The terms described below are defined in consideration of the functions in this embodiment, which may vary depending on the intention or custom of the user and the operator. Therefore, the definitions of these terms should be based on the contents throughout this specification. In addition, the following embodiments are not intended to limit the scope of the present invention, but merely as examples, and various embodiments may be implemented through the present invention.

Hereinafter, preferred embodiments of the present invention will be described in detail with reference to the accompanying drawings. As used herein, the term "lighting module or lighting apparatus" is used to refer to lighting for indoor or outdoor use and is used as a generic term for flat plate lamps, light fixtures, street lamps, various lamps, electric sign boards, headlights, and similar devices.

FIG. 1 is an exploded perspective view of a lighting apparatus according to an embodiment, FIG. 2 is an assembled perspective view of the lighting apparatus of FIG. 1, FIG. 3 is a side sectional view of the lighting apparatus of FIG. 2, FIG. 4 is an enlarged view of a first back cover of the lighting apparatus of FIG. 3, and FIG. 5 is an enlarged view of a light emitting module, a heat radiation body, and a first reflection sheet attached to the light emitting module and the heat radiation body of the lighting apparatus of FIG. 1.

Referring to FIG. 1 to FIG. 5, the lighting apparatus 100 includes a housing 110 that has at least one back cover 111 and 112, a heat radiation body 150 that is disposed at a lower side of the back cover 111 and 112, light emitting modules 170 and 170A that are disposed on the heat radiation body 150, and a transparent sheet 180 that is disposed on recesses 115 and 115A under the back covers 111 and 112.

The housing 110 includes a back cover 111, 112 having recesses 115, 115A which are convexly recessed at a lower portion thereof. At least one of the back covers 111 and 112 may be disposed on the housing 110. The back covers 111 and 112 may include first and second back covers 111 and 112 symmetrical to each other about a center line. The first and second back covers 111 and 112 form the appearance of the lighting apparatus.

The contour line of the back covers 111 and 112 may include a plurality of parabola shapes, ellipse shapes, or hyperbolic shapes. The inner surface of each of the back covers 111 and 112 may include a parabolic shape, an ellipse shape, or a curved shape. The inner surfaces of the back covers 111 and 112 may be reflection surfaces. The first and second back covers 111 and 112 may be linearly symmetrical about the center line or the heat radiation body 150. A power supply device (not illustrated) may be provided on the back covers 111 and 112 but the present invention is not limited thereto.

The recesses 115 and 115A are disposed below the first and second back covers 111 and 112, respectively and open downwardly and have both side walls.

As illustrated in FIG. 3, the lengths of a first axis X direction X1 and the lengths of the second axis Z direction in the back covers 111 and 112 may be the same or different from each other. The height Y1 or the thickness of the housing 110 or the back covers 111 and 112 may be 1/10 or less of the length in the first axis X direction and/or the second axis Z direction and may be in a range from 49 mm to 59 mm, for example. By arranging the height Y1 of the back covers 111 and 112 to be 1/10 or less of the lengths in the first axis X direction and/or the second axis Z direction, a lighting apparatus having a slim thickness compared to the size can be provided. Here, the first axis X direction and the second axis Z direction may be directions orthogonal to each other on the same plane and the third axis Y direction may be a direction perpendicular to the first and second axes X and Z directions. The first axis X and the second axis Z directions may be a horizontal direction with respect to the lower surface of the lighting apparatus and the third axis Y direction may be a direction perpendicular to the lower surface of the lighting apparatus.

An engaging protrusion 113 may be disposed on an outer circumference of the housing 110 and the engaging protrusion 113 may be coupled to another structure, for example, a ceiling.

The back covers 111 and 112 may include a plastic material and may include at least one of polycarbonate (PC), polyethylene terephthalate glycol (PETG), polyethylene (PE), polypropylene paper (PSP), polypropylene (PP), and polyvinyl chloride (PVC), for example.

The back covers 111 and 112 may be formed of a material having a reflectance which is higher than a transmittance and a material having a reflectance of 70% or more, for example, 80% or more. By increasing the reflectance of the back covers 111 and 112, light incident on the surfaces of the back covers 111 and 112 can be reflected. The back covers 111 and 112 may be formed of a material having a light absorption rate of 20% or less, for example, 15% or less but the present invention is not limited thereto. The inner surfaces of the back covers 111 and 122 may be further provided with additional components for increasing the reflectance. For example, the reflection films may be further disposed but the present invention is not limited thereto.

As illustrated in FIG. 4, a fastening hole 105 for fixing to another structure may be disposed on the back covers 111 and 112, and a plurality of fastening holes 105 may be disposed, but the present invention is not limited thereto. Since the back covers 111 and 112 have a symmetrical shape to each other, hereinafter, one back cover will be described as a reference for convenience of explanation.

The heat radiation body 150 may be disposed under one side of the back cover 111. The heat radiation body 150 may be disposed under one region of the first back cover 111. The heat radiation body 150 may be disposed under center regions of the first and second back covers 111 and 112.

The heat radiation body 150 may be formed of a metal material, and may include at least one of metals such as aluminum, copper, nickel, and silver, but the present invention is not limited thereto. The heat radiation body 150 may include a carbon material but the present invention is not limited thereto.

As illustrated in FIG. 3 and FIG. 5, the heat radiation body 150 includes heat radiation portions 151 and 151A and reflection portions 153 and 153A. The heat radiation portions 151 and 151A may be formed as flat surfaces and may be disposed to face the back covers 111 and 112. The heat radiation portions 151 and 151A may include a first heat radiation portion 151 disposed at one side of the first back cover 111 and a second heat radiation portion 151A disposed at one side of the second back cover 112. The first and second heat radiation portions 151 and 151A may be disposed to be tilted in the direction of each of the recesses 115 and 115A about the third axis Y. The first and second heat radiation portions 151 and 151A may be disposed to face the second reflection sheets 165 and 165A since an outer angle θ5 thereof has 100 degrees or more, for example, in a range of 120 degrees to 140 degrees. In a case where the outer angle θ5 of the first and second heat radiation portions 151 and 151A is smaller than the above range, the light emitting modules 170 and 170A are disposed to face the transparent sheet 180 and thus there is a problem that the main light is directly radiated, and in a case where the outer angle θ5 of the first and second heat radiation parts 151 and 151A is larger than the above range, there is a problem that the light emitting modules 170 and 170A irradiate the main light to the boundary portions of the first and second reflection sheets 160 and 165. The first and second heat radiation portions 151 and 151A are disposed to be inclined toward directions opposite to each other about the center line of the housing 110 so that the main light can be irradiated in the direction of the second reflection sheets 165 and 165A disposed in the first and second heat radiation portions 151 and 151A.

The first reflection portion 153 may be disposed between the first heat radiation portion 151 and the first back cover 111 and the second reflection portion 153A may be disposed between the second heat radiation portion 151A and the second back cover 112.

The first reflection portion 153 has a curved shape and may extend from the first heat radiation portion 151 to the first back cover 111 in a curve line in which a contour line of the inner curved surface of the first back cover 111 extends. The second reflection portion 153A has a curved shape and may extend from the second heat radiation portion 151A to the second back cover 112 in a curve in which a contour line of the inner curved surface of the second back cover 112.

The lower end portion 152 of the heat radiation body 150 includes an engaging groove 154 and the lower end portion of the transparent sheet 180 may be disposed in the engaging groove 154. The lower end portion 152 of the heat radiation body 150 may be bent and bent in a direction of the back covers 111 and 112, for example. Accordingly, light that deviates from a range of an oriented angle irradiated from the light emitting diode 173 can be reflected. The oriented angle of the light emitting diode 173 may be 115 degrees or more, for example, in a range of 118 degrees to 130 degrees, but the present invention is not limited thereto.

The edge portion of the lower end portion 152 of the heat radiation body 150 protrudes further than the horizontal line of the light emitting surface of the light emitting diode 173 to reflect the incident light to the second reflection sheet 165. A reflection sheet or a reflection layer may be disposed on the inside of the lower end portion 152, but the present invention is not limited thereto.

The upper portions 155 and 155A of the heat radiation body 150 may be bent from the reflection portions 153 and 153A and the region 157 between the reflection portions 153 and 153A may be a space, be coupled with the protrusion portion of the back covers 111 and 112, and be filled with a heat radiation body material, but the present invention is not limited thereto.

Referring to FIG. 6, the upper portion 155 of the heat radiation body 150 may be inserted into the groove 117A of the center side connection portion 117 of the back cover 111 and then be fixed by the coupling member, and the coupling member may include, but is not limited to, adhesives, fasteners, or hooks.

As illustrated in FIG. 1 and FIG. 5, the light emitting modules 170 and 170A may be disposed on the heat radiation portions 151 and 151A of the heat radiation body 150. The light emitting modules 170 and 170A include a first light emitting module 170 disposed on the first heat radiation portion 151 and a second light emitting module 170A disposed on the second heat radiation portion 151A.

Each of the light emitting modules 170 and 170A includes a circuit board 171 and a plurality of light emitting diodes 173 disposed on the circuit board 171.

The circuit board 171 may be disposed long on the heat radiation portions 151 and 151A in the longitudinal direction Z of the heat radiation body 150. One circuit board 171 or a plurality of circuit boards 171 may be disposed on the heat radiation portions 151 and 151A but the present invention is not limited thereto.

The circuit board 171 may be adhered to the heat radiation portions 151 and 151A by screws or/and adhesives but the present invention is not limited thereto.

The circuit board 171 may include, for example, a printed circuit board (PCB). The printed circuit board includes at least one of a resin material PCB, a metal core PCB (MCPCB), and a flexible PCB (FPCB) and may be provided as a metal core PCB for heat radiation, for example.

The light emitting diode 173 may emit at least one of blue, red, green, white, and UV as a package in which the light emitting chip is packaged. For example, white light may be emitted for illumination. The light emitting diode 173 may be mounted on the circuit board 171 in a chip form. In this case, the light emitting diode 173 may have an oriented angle of 115 degrees or more, and may be in range of 118 degrees to 130 degrees for example, but the present invention is not limited thereto.

One row or two or more rows of the light emitting diodes 173 may be arranged on the circuit board 171 but the present invention is not limited thereto.

The light emitting diode 173 according to the embodiment may include a warm white LED and a cool white LED on the circuit board 171, for example. The warm white light emitting element and the cool white light emitting element emit white light. Since the warm white light emitting element and the cool white light emitting element can emit the white light of the mixed light by emitting the correlated color temperature, respectively, the color rendering index (CRI) indicating the close proximity to the natural sunlight becomes high. Therefore, it is possible to prevent the color of the actual object from being distorted, and thus the fatigue of the user's eyes is reduced. In the embodiment, the light emitting diode 173 may include a light emitting element having a temperature between a warm white color temperature and a cool white color temperature, such as a neutral white light emitting element and/or a pure white light emitting element.

Referring to FIG. 3 to FIG. 6, the first reflection sheet 160 may be disposed on the heat radiation body 150. A second reflection sheet 165 may be disposed on the inner surface of the back covers 111 and 112. The second reflection sheet 165 may be disposed in a region between the first reflection sheet 160 and the transparent sheet 180 among the inner regions of the first and second back covers 111 and 112.

The first reflection sheet 160 may include a material different from the second reflection sheet 165. The first reflection sheet 160 may include a regular reflection sheet or a mirror sheet and the second reflection sheet 165 may include a diffused reflection sheet or a white sheet. The first reflection sheet 160 controls the path of the incident light to cause the incident light to be regularly reflected so as to irradiate the light to regions of the second reflection sheet 165 which are different from each other and the second reflection sheet 165 causes the incident light to be diffusely reflected and to be irradiated so that light is not concentrated on a specific region of the transparent sheet 180. Thus, a bright line which can be generated in the transparent sheet 180 can be prevented.

The first reflection sheet 160 includes Ag and Al materials. The second reflection sheet 165 may be formed of a white plastic material such as polycarbonate (PC), or may include a nano-coated layer, a metal layer or a resin layer having a pattern formed thereon.

The second reflection sheet 165 may include a curved surface having a plurality of inflection points but the present invention is not limited thereto. Since the second reflection sheet 165 has a curved surface having a plurality of inflection points, it is possible to provide light that is diffusely reflected to regions of the transparent sheet 180 which are different from each other, and thus the generation of bright lines is suppressed.

The transparent sheet 180 may be a sheet having a diffusing agent or may include a diffusion sheet material. The transparent sheet 180 may include at least one of a diffusion sheet such as polymethyl methacrylate (PMMA), polypropylene (PP), polyethylene (PE), and polystyrene (PS).

The transparent sheet 180 may be caught and fixed to the engaging groove 154 of the lower end portion 152 of the heat radiation body 150 and the engaging groove 118 of the back covers 111 and 112.

Here, the transparent sheet 180 may be disposed in an oblique shape between the high point of the recesses 115 and 115A of the back covers 111 and 112 and the heat radiation body 150. The engaging groove 118 may protrude from the high point of the recesses 115 and 115A of the back cover 111 and 112.

The first and second reflection sheets 160 and 165 include a material having a light reflectance of 90% or more and the first reflection sheet 160 includes a material having a reflectance higher than that of the second reflection sheet 165. Light can be reflected without loss of incident light by such a light reflectance and the light extracting effect can be improved.

Here, the first reflection sheet 160 may be removed in a case where the heat discharger 150 is a regular reflection material but the present invention is not limited thereto. The second reflection sheet 165 may be removed in a case where the surfaces of the back covers 111 and 112 are diffusely reflected but the present invention is not limited thereto.

Referring to FIG. 8, the transparent sheet 180 may be disposed in an oblique type. The transparent sheet 180 may be disposed to be inclined at an angle θ2 ranging from 25 degrees to 40 degrees about the horizontal axis X1, and may be disposed to be inclined at an angle ranging from 30 degrees to 35 degrees, for example. In a case where the transparent sheet 180 deviates from the angle θ2, the distribution of light reflected from the first and second reflection sheets 160 and 165 may become uneven. In addition, the transparent sheet 180 can be directly irradiated with the second side light in the left direction emitted from the light emitting diode 173 by the inclination angle θ2.

The light emitting surface of the light emitting diode 173 or the lower surface of the circuit board 171 may be disposed to be inclined at a predetermined angle θ1 about the horizontal axis X1 and may be inclined at an angle ranging from 23 degrees to 27 degrees, for example. The main light and the first side light in the right direction can be effectively irradiated to the regions of the first and second reflection sheets 160 and 165 by such an inclination angle θ1. The inclination angle θ1 may be smaller than the inclination angle θ2 of the transparent sheet 180. In a case where the inclination angle θ1 deviates from the above range, light may not be uniformly irradiated to the regions of the first and second reflection sheets 160 and 165.

The angle θ3 between the straight line −X2 extending from the light emitting surface of the light emitting diode 173 and the transparent sheet 180 may vary depending on the angles θ1 and θ2. The light emitting surface of the light emitting diode 173 may be an upper surface or a light emitting surface.

The horizontal straight line distance D0 between the center P0 of the light emitting surface of the light emitting diode 173 and the first reflection surface S1 of the first reflection sheet 160 may be 8 mm or more for example, 9 mm or more. The straight line distance D0 may vary depending on the curvature of the first reflection surface S1 and the oriented angle of the light emitting diode 173. In a case where the straight line distance D0 is less than 8 mm, there may be generated a problem that light reflected from the first reflection surface S1 is irradiated to the transparent sheet 180 without being irradiated to the second reflection sheet 165.

The minimum distance between the center P0 of the light emitting surface of the light emitting diode 173 and the transparent sheet 180 may range from 1.8 to 2.3 times the distance D0. In other words, if the distance between the center P0 of the light emitting surface of the light emitting diode 173 and the transparent sheet 180 is too close to each other, hot spots may be generated and in a case where the distance is too far apart, there may be a difference in the light distribution and uniformity of the other regions.

Meanwhile, as illustrated in FIG. 9, the reflection portions 153 and 153A of the heat radiation body 150 may include a curved surface M1 and a plurality of inclined surfaces M2, M3, M4, M5 and M6. The curved surface M1 is a region adjacent to the circuit board 171 and can be disposed in a region that deviates from the half angle (½ of oriented angle) of the oriented angle of the light emitting diode 173 about the optical axis Y0. The plurality of inclined surfaces M2, M3, M4, M5, and M6 may be a curved surface or a flat surface with positive curvature. The plurality of inclined surfaces M2, M3, M4, M5 and M6 extend from the curved surface M1 and the distance from the light emitting diode 173 may be gradually increased. The plurality of inclined surfaces M2, M3, M4, M5, and M6 may be at least two surfaces, for example, four or more surfaces but the invention is not limited thereto.

Stepped portions M11, M12, M13, and M14 may be disposed between the plurality of inclined surfaces M2, M3, M4, M5, and M6 but the present invention is not limited thereto. In a case where the stepped portions M11, M12, M13, and M14 are not provided, there is a problem that the thickness of the first reflection sheet 160 becomes thick since steps are formed on the first reflection sheet 160.

Referring to FIG. 7, the axis perpendicular to the light emitting surface of the light emitting diode 173 may be referred to as an optical axis Y0. The axis orthogonal to the optical axis Y0 from the center P0 of the light emitting surface of the light emitting diode 173 as a starting point may be referred to as a first forward axis X2 and a first backward axis −X2. The axes X2 and −X2 may be an axis which is horizontal to the light emitting surface of the light emitting diode 173.

An angle ratio (A2:A1) between a region connecting the both ends of the first reflection sheet 160 with the light emitting diode 173 as a starting point P0 within the region between the optical axis Y0 and the first forward axis X2 and the region connecting the both ends of the second reflection sheet 165 may be in a range of 6.5:2.5 to 7.5:1.5 and the angle ratio A2:A1 is an angle value obtained by substituting 90 degrees with 1/10. The light is uniformly irradiated to the entire region of the transparent sheet 180 by the angle ratio (A2:A1) between the regions of the two sheets 160 and 165 existing in the left region (or inner region) about the optical axis Y0 and in a case of deviating from the angle ratio (A2:A1), glare may be generated in a portion region of the transparent sheet 180.

A angle ratio (A3:A11) between a region (angle A11) connecting a exposed both ends of the transparent sheet 180 and a region (angle A3) connecting both ends of the second reflection sheet 165 based on the light emitting surface center P0 of the light emitting diode 173 in the region between the optical axis Y0 and the first backward direction axis −X2 opposite to the first forward direction axis X2 from the light emitting diode as a starting point may have a range of 3.5:5.5 to 4.5:4.5 and this angle ratio (A3:A11) is an angle value obtained by substituting 90 degrees with 1/10. Light may be uniformly irradiated to the entire region of the transparent sheet 180 by the angle ratio (A3:A11) between the regions of two sheets 165 and 180 existing a right region (or an outer region) based on the optical axis Y0 and in a case of deviating from the angle ratio (A3:A11), glare may be generated in a portion of the transparent sheet 180. Here, the right region about the optical axis Y0 may be a center region of the lighting apparatus 180 or the inner region of the recesses 115 and 115A.

In addition, the point Px at which the light travelling to the optical axis Y0 is reflected by the second reflection sheet 165 and vertically incident on the transparent sheet 180 may exist in a region B2 of the half angle A6 of the oriented angle of the light emitting diode 173.

Referring to FIG. 7, if the oriented angle or the half angle of the light emitting diode 173, and the region of each sheet along the optical path are described in detail, an angle A0 is an oriented angle of the light emitting diode 173, an angle A1 is a diffused reflection region in a right side about the optical axis Y0, an angle A2 is a regular reflection region, an angle A3 is a diffused reflection region in a left side about the optical axis Y0, an angle A4 is an angle within a range in which the effective light is irradiated among the light which deviates from the half angle of the oriented angle, an angle A5 is an angle between a light L0 which is incident on the transparent sheet 180 perpendicular to a tangent line formed by a contact point at which light travelling to the optical axis Y0 from the light emitting diode 173 meets the second reflection sheet 165 and the second reflection sheet 165 from the contact point as a starting point and a straight line which is formed by a light which is vertically incident on the surface of the transparent sheet 180 from the contact point, an angle A6 represents a half angle of the oriented angle, an angle A7 is an angle within a range in which the effective light is irradiated to the transparent sheet 180 among the light which deviates from the half angle of the oriented angle, an angle A8 represents an inclination angle between the light that is reflected from a contact point at which light travelling to the optical axis Y0 from the light emitting diode 173 meets the second reflection sheet 165 and directs to a boundary region of the heat radiation body 150 from the contact point as a starting point and the transparent sheet 180 an angle A9 represents an inclination angle between a light L0 which is vertically incident on a predetermined point Py of the transparent sheet 180 from a tangent line formed by a contact point at which light travelling to the optical axis Y0 from the light emitting diode 173 meets the second reflection sheet 165 from the contact point as a starting point and the transparent sheet 180. Here, a straight line perpendicular to the surface of the second reflection sheet 165 at the contact point or a straight line perpendicular to the surface of the transparent sheet 180 may be defined as a normal vector.

The angle A0 may be 115 degrees or more, may be in a range of 115 degrees to 136 degrees, for example, and the directional angle A0 may vary depending on the directing characteristic of the light emitting diode 173, but the present invention is not limited thereto. The angle A6 may be a half angle of the oriented angle.

The sum of the angles A1 and A2 may be 90 degrees and the sum of the angles A1 and A3 may be in a range of 65 degrees to 75 degrees which is an angle of the diffused reflection region and may be larger than the angle of the regular reflection region. This is because the length of the back cover 11 is longer than the thickness of the back cover 11, so that the diffused reflection region described above can be larger than the regular reflection region.

The angle A5 is in a range of 21 to 25 degrees and may be a region to which the diffusely reflected light from the second reflection sheet 165 is irradiated. The angle A7 may be in a range of 15 degrees to 20 degrees and the effective angle A7 may vary depending on the oriented angle of the light emitting diode 173.

The first reflection sheet 160 may be disposed on the reflection portions 153 and 153A of the heat radiation body 150. Hereinafter, for convenience of explanation, the reflection portions 153 and 153A will be described with reference to the first reflection portion 153 disposed below the first back cover 111.

The first reflection sheet 160 may be disposed on the reflection portion 153 between the circuit board 171 and the back cover 111 in the region of the heat radiation body 150, respectively. The first reflection sheet 160 may be formed along the surface shape of the reflection portion 153 and may include a curved reflection surface S1 and a plurality of inclined reflection surfaces S2, S3, S4, S5, and S6. The reflection surfaces S1 to S6 may include at least two, for example, four or more surfaces, but the invention is not limited thereto.

Four to eight inclined reflection surfaces S2, S3, S4, S5 and S6 may be formed, and there are problems that in a case where the number of the inclined reflection surfaces S2 to S6 exceeds the above range, since the extent of each of the inclined surfaces S2 to S6 is too small, control of the light distribution is difficult and in a case where the number thereof is less than the above range, since the extent of each of the inclined surfaces S2 to S6 becomes too large, uniform light cannot be irradiated to the entire region of the transparent sheet 180.

The first reflection sheet 160 may be formed in the same shape as the surface shape of the reflection portion 153 since the first reflection sheet 160 is in close contact with the reflection portion 153 of the heat radiation body 150.

The first reflection sheet 160 may include a plurality of reflection surfaces, for example, first to sixth reflection surfaces S1, S2, S3, S4, S5, and S6, the first reflection surface S1 is adjacent to the circuit board 171 and has a curved shape with positive curvature, and the second to sixth reflection surfaces S2, S3, S4, S5, and S6 may be flat or a curved surface having a positive curvature. The second reflection surface S2 is disposed on an extension of the first reflection surface S1, the third to fifth reflection surfaces S3, S4 and S5 are disposed between the second reflection surface S2 and the sixth reflection surface S2, and the sixth reflection surface S6 may be adjacent to the first and second back cover 111 and 112. The first reflection surface S1 may be the closest reflection surface closest to the light emitting diode 173 and the sixth reflection surface S6 may be the outermost reflection surface adjacent to the back cover 111 and 112.

Meanwhile, in the first reflection sheet 160, the widths of the third and fifth reflection surfaces S3 and S5 among the second to sixth reflection surfaces S2, S3, S4, S5, and S6 are wider than those of the second, fourth, and sixth reflection surfaces S2, S4, and S6. In other words, the inclined reflection surfaces S2 to S6 may be disposed with surfaces having a wide width between surfaces having a narrow width. Accordingly, the lights regularly reflected from the third and fifth reflection surfaces S3 and S5 are mixed with the light reflected from the second, fourth, and sixth reflection surfaces S2, S4, and S6 to be capable of being irradiated to the transparent sheet 180. For example, a surface having a wide width may reflect light to irradiate the transparent sheet 180, some light that is not uniformly irradiated to the transparent sheet 180 by the surface having a wide width, and may be uniformly irradiated with the transparent sheet 180 by the surfaces having a narrow width, but the invention is not limited thereto.

Referring to FIG. 10, the straight line distances D1, D2, D3, D4 and D5 from the center P0 of the light emitting surface of the light emitting diode 173 as a starting point to the center points P1, P3, P5, P7, and P9 between the second reflection surface S2 and the sixth reflection surface S6 to the sixth reflection surface S6 can be gradually lengthened. The straight line distance between the centers (for example, P1, P2, and P3) of two adjacent reflection surfaces in the second to sixth reflection surfaces S2, S3, S4, S5, and S6 may range from 2 mm to 5 mm, in a case of being smaller than a range described above, since the cover region of the inclined reflection surface S2, S3, S4, S5, and S6 is too small, the effect is insignificant for uniform light distribution, and in a case of being larger than the above range, since the cover region of inclined reflection surface S2, S3, S4, S5, and S6 may become too large, a uniform light distribution over the entire region of the transparent sheet 180 cannot be controlled.

The straight line distance D1 from the center P0 of the light emitting surface of the light emitting diode 173 as a starting point to the center P1 of the second reflection surface S2 may be, for example, 20 mm or less, and may be in a range of 13 mm to 17 mm, for example. The straight line distance D1 may vary depending on the size of the lighting apparatus, but the invention is not limited thereto.

The straight line distance D5 from the center P0 of the light emitting surface of the light emitting diode 173 as a starting point to the center P9 of the sixth reflection surface S6 may be 30 mm or less, for example and may be in a range of 25 mm to 30 mm, for example. The straight line distance D5 may vary depending on the thickness of the lighting apparatus, but the invention is not limited thereto. Here, in a case where the sixth reflection surface S6 is a curved surface, it may have a radius of curvature ranging from 10 to 12 mm, and in a case where the radius of curvature deviates from a range, optical path control may be difficult.

The first angle (R1) between the first forward axis X2 which is horizontal to the light emitting surface of the light emitting diode 173 and an ending point (or starting point of second reflection surface (S2)) (P1*a*) from the center P0 of the light emitting surface of the light emitting diode 173 as a starting point may be 30 degrees or less and may be in a range of 20 degrees to 26 degrees, for example. This is the region of the first reflection surface S1, which can be defined as an effective region which deviates from the half angle of the oriented angle, and can vary according to the oriented angle of the light.

The second angle (R2, R2>R1) between the first forward axis X2 and an ending point (or starting point of third reflection surface S3) of the second reflection surface S2 from the center P0 of the light emitting surface of the light emitting diode 173 as a starting point may be 40 degrees or less and may be 36 degrees or less, for example.

The third angle (R3, R3>R2) between the first forward axis X2 and an ending point (or starting point of fourth reflection surface S4) of the third reflection surface S4 from the center P0 of the light emitting surface of the light emitting diode 173 as a starting point may be 52 degrees or less and may be 48 degrees or less, for example.

The fourth angle (R4, R4>R3) between the first forward axis X2 and an ending point (or starting point of fifth reflection surface S5) of the fourth reflection surface S4 from the center P0 of the light emitting surface of the light emitting diode 173 as a starting point may be 60 degrees or less and may be 55 degrees or less, for example.

The fifth angle (R5, R5>R4) between the first forward axis X2 and an ending point (or starting point of sixth reflection surface S6) of the fifth reflection surface S5 from the center P0 of the light emitting surface of the light emitting diode 173 as a starting point may be 67 degrees or less and may be 65 degrees or less, for example.

The sixth angle (R6, R6>R5) between the first forward axis X2 and an ending point of the sixth reflection surface S6 setting the center P0 of the light emitting surface of the light emitting diode 173 as a reference point may be 70 degrees or less and may be 67 degrees or less, for example.

The inclined second to sixth reflection surfaces S2, S3, S4, S5, and S6 are provided as a plurality of inclined surfaces within a range of 90 degrees about the first forward axis X2 and thus the first side light can be effectively reflected to regions which are different from each other.

When viewing the angle formed by the imaginary straight line connecting the starting point and the ending point of the second to sixth reflection surfaces S2, S3, S4, S5, S6 and the center P0 of the light emitting surface of the diode 173 In a triangle formed by connecting the center P0 of the light emitting surface of the light emitting diode 173 and the starting point and the ending point, that is, the both points, of the second to sixth reflection surfaces S2, S3, S4, S5 and S6, the angles of the third and fifth reflection surface S3 and S5 may be larger than the angles of the other reflection surfaces S2, S4 and S6 and the angle of the sixth reflection surface S6 may be the smallest. This can be varied depending on the extent and inclination angle of the second to sixth reflection surfaces S2 to S6. Here, the second to sixth reflection surfaces S2, S3, S4, S5, and S6 may have a spherical surface or an aspheric surface.

Referring to FIG. 11, the reflection angles R6, R7, R8, R9, and R10 formed by the second to sixth reflection surfaces S2, S3, S4, S5, S6 with respect to the straight line X3 horizontal to the first axis X direction may be larger as being adjacent to the light emitting diode 173 and may be smaller as being far from the light emitting diode 173. The first side light emitted from the light emitting diode 173 is irradiated to regions which are different from each other by the inclined reflection surfaces S2, S3, S4, S5 and S6 having the angles R6, R7, R8, R9 and R10 and thus a uniform light distribution can be obtained.

The reflection angles R6, R7, R8, R9, and R10 formed by the second to sixth reflection surfaces S2, S3, S4, S5, and S6 with respect to the horizontal straight line X3 may be angles which are different from each other. The second to fifth reflection surfaces S2, S3, S4 and S5 have a range of 50 to 67 degrees with respect to the horizontal straight line X3 and reflect the incident light to the upper region (B2 in FIG. 7) of the transparent sheet 180. The sixth reflection surface S6 has a reflection surface R10 that is smaller than the reflection angles R6, R7, R8, and R9 formed by the second to fifth reflection surfaces S2, S3, S4, and S5 with respect to the horizontal straight line X3 and uniformly irradiates the incident light onto the entire upper region B2 of the transparent sheet 180.

The reflection angles R6, S7, R8, and R9 formed by the second to fifth reflection surfaces S2, S3, S4, and S5 may become gradually smaller as the distance from the light emitting diode 173 increases.

Here, when viewing the reflection angles R6, R7, R8, R9, and R10 of the second through sixth reflection surfaces S2, S3, S4, S5, and S6 formed with respect to the straight line X3 horizontal to the first axis X direction, the second reflection surface S2 can be inclined at a reflection angle R6 ranging from 63 degrees to 67 degrees, for example, from 64 degrees to 66 degrees, with respect to the horizontal straight line X3. The third reflection surface S3 may be inclined at a reflection angle R7 ranging from 59 degrees to 63 degrees, for example, from 60 degrees to 62 degrees, with respect to the horizontal straight line X3. The fourth inclined surface S4 may be inclined at a reflection angle R8 ranging from 53 degrees to 57 degrees, for example, from 54 degrees to 56 degrees, with respect to the horizontal straight line X3. The fifth reflection surface S5 may be inclined at a reflection angle R9 ranging from 50 degrees to 55 degrees, for example, from 51 degrees to 53 degrees, with respect to the horizontal straight line X3. The sixth reflection surface S6 may be inclined at a reflection angle R10 ranging from 31 degrees to 37 degrees, for example, from 32 degrees to 36 degrees, with respect to the horizontal straight line X3. The light regularly reflected by the reflection angles R6, R7, R8, R9 and R10 of the second to sixth reflection surfaces S2, S3, S4, S5 and S6 can be irradiated to the transparent sheet 180 in a uniform distribution.

As illustrated in FIG. 12, the light L2 reflected by the second to fifth reflection surfaces S2, S3, S4, and S5 among the first side light emitted from the light emitting diode 173 is irradiated to the upper region B2 of the transparent sheet 180. At this time, the upper region B2 irradiated with the light L2 reflected by the second to fifth reflection surfaces S2, S3, S4 and S5 of the regions of the transparent sheet 180 can be distributed above the point Px at which the light travelling to the optical axis Y0 is reflected to the second reflection sheet 165 and is perpendicular to the transparent sheet 180 (see FIG. 16(A)). The light L2 reflected by the inclination angle of the third to fifth reflection surfaces S2 to S5 is irradiated to the upper region B2 of the point Px of the transparent sheet 180 and thus the right side light of the light emitting diode 173 about the optical axis Y0 can be effectively used.

As illustrated in FIG. 13, the sixth reflection surface S6 reflects the incident light L4 among the first side lights emitted from the light emitting diode 173 and the upper region B2 above the point Px of the transparent sheet 180 can be uniformly irradiated (see FIG. 16(C)).

As illustrated in FIG. 14, the first reflection surface S1 reflects the light L5 deviating from the oriented angle of the light emitting diode 173 of the first side light emitted from the light emitting diode 173 to the entire region of the second reflection sheet 165. In this case, the second reflection sheet 165 reflects the light reflected by the first reflection surface S1 back to the transparent sheet 180 (see FIG. 16(B)).

As illustrated in FIG. 15, the second side light in the left side direction emitted from the light emitting diode 173 may be directly irradiated onto the transparent sheet 180 and irradiated to the point Px and the region B1 below the point Px.

Accordingly, the light emitted from the light emitting diode 173 can be effectively irradiated to the entire region of the transparent sheet 180.

In addition, the optical axis Y0 emitted from the light emitting diode 173 and the main light in the region adjacent to the optical axis Y0 can be reflected by the second reflection sheet 165 and irradiated onto the entire region of the transparent sheet 180.

Light Emitting Device Package

FIG. 17 is a sectional view showing a light emitting diode according to the embodiment.

Referring to FIG. 17, the light emitting diode 200 includes a body 210; first and second lead electrodes 211 and 213, at least portions of which are disposed in the body 210, a light-emitting device 101 electrically connected to the first and second lead electrodes 211 and 212 on the body 210, and a molding member 220 surrounding the light emitting device 101.

The body 210 may be formed of at least one of a silicon material, a synthetic resin material and a metallic material. The body 210 may include a cavity formed therein and a reflective portion 215 having an inclined surface at the periphery thereof.

The first lead electrode 211 and the second lead electrode 213 are electrically separated from each other, and are formed to pass through the body 210. That is, the inner side portions of the first and second lead electrodes 211 and 212 may be disposed in the cavity and the other portions of the first and second lead electrodes 211 and 212 may be disposed at an outside of the body 210.

The first lead electrode 211 and the second lead electrode 212 provide power to the light-emitting device 100 Also, the first lead electrode 211 and the second lead electrode 213 reflect the light emitted from the light emitting device 101, thus improving the light emitting efficiency. Also, the first lead electrode 211 and the second lead electrode 213 may serve to discharge the heat generated from the light emitting device 101.

The light emitting device 101 may be disposed on the body 210, or may be formed on the first lead electrode 211 and/or the second lead electrode 212. The light emitting device 101 may be arranged as at least one LED (Light Emitting Diode) chip. The LED chip may include a light emitting diode in a visible light band such as red, green, blue or white, or a UV light emitting diode that emits ultraviolet (UV) light. A phosphor layer may be further disposed on the surface of the light emitting device 101, but the present invention is not limited thereto.

The wire 216 of the light emitting device 101 may be electrically connected to at least one of the first and second lead electrodes 211 and 212, but the embodiment is not limited thereto.

The molding member 220 may surround the light-emitting device 101 to protect the light emitting device 101. Also, the molding member 220 may include a fluorescent material to change the wavelength of light emitted from the light emitting device 101. The upper surface of the molding member 220 may be flat, concave or convex. The upper surface of the molding member 220 or the cavity region may be the light emitting surface according to the embodiment, but the present invention is not limited thereto.

A lens may be disposed on the molding member 220, but the present invention is not limited thereto.

The light emitting diode 200 may be a blue light emitting device or a white light emitting device having a high color rendering index (CRI). The light emitting diode may be a light emitting device that emits white light by molding a synthetic resin containing a phosphor on a blue light emitting chip. The phosphor may include at least one of a garnet (YAG, TAG), a silicate, a nitride, and an oxy-nitride.

The features, structures, effects and the like described in the embodiments are included in at least one embodiment of the present invention, and are not necessarily limited to only one embodiment. Furthermore, the features, structures, effects and the like illustrated in the embodiments can be combined and modified by other persons skilled in the art to which the embodiments belong. Therefore, it is to be understood that the present invention is not limited to these embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

INDUSTRIAL APPLICABILITY

The embodiment can be applied to a flat plate lighting apparatus.

The embodiment can be applied to an indirect lighting apparatus having a light emitting diode.

The invention claimed is:

1. A lighting apparatus comprising:

a housing including a first back cover whose inner surface has a parabolic shape and including a recess opened under the first back cover;

a first light emitting module including a circuit board and a plurality of light emitting diodes which are arranged on the circuit board;

a heat radiation body disposed in one region of the first back cover, the heat radiation body including a first heat radiation portion in which the circuit board is disposed and a first reflection portion which extends from the first heat radiation portion along a contour line of an inner spherical surface of the first back cover;

a transparent sheet disposed in an oblique direction between an upper portion of the recess of the first back cover and a lower portion of the heat radiation body;

a first reflection sheet disposed on the heat radiation body and reflecting a first side light emitted from the plurality of light emitting diodes to the transparent sheet; and a second reflection sheet disposed on an inner surface of the first back cover and reflecting a main light emitted from the plurality of light emitting diodes to the transparent sheet, wherein the first reflection sheet includes a plurality of reflection surfaces, wherein a lower portion of the transparent sheet is disposed at the lower portion of the heat radiation body, wherein the lower portion of the transparent sheet is disposed closer to the light emitting diodes than an upper portion of the heat radiation body, and wherein the plurality of reflection surfaces includes a first reflection surface which is adjacent to the light emitting diodes and at least four inclined reflection surfaces which are bent at a plurality of stages from the first reflection surface.

2. The lighting apparatus according to claim 1, wherein the transparent sheet includes a diffusion sheet.

3. The lighting apparatus according to claim 2, wherein the transparent sheet and the light emitting diodes are inclined in a different angle from each other to a horizontal straight line, and wherein a lower surface of the circuit board is inclined with respect to the horizontal straight line.

4. The lighting apparatus according to claim 3, wherein the first reflection sheet includes a regular reflection material.

5. The lighting apparatus according to claim 4, wherein the second reflection sheet includes a diffused reflection material.

6. The lighting apparatus according to claim 2, wherein the first reflection sheet includes a regular reflection sheet, wherein the second reflection sheet includes a diffused reflection sheet, and wherein an angle ratio between the second reflection sheet and the transparent sheet which is disposed at a region between an optical axis and a first axis orthogonal to the optical axis from the light emitting diodes a starting point has a range of 3.5:5.5 to 4.5:4.5.

7. The lighting apparatus according to claim 2, wherein a light which is vertically reflected by the second reflection sheet among the lights vertically irradiated from a light emitting surface of the light emitting diodes is irradiated to a region which deviates from a half angle of an oriented angle of the light emitting diodes.

8. The lighting apparatus according to claim 2, wherein the second reflection sheet is disposed on a region between the transparent sheet and the first reflection sheet.

9. The lighting apparatus according to claim 2, wherein each of the light emitting diodes has a body and a light emitting element which is disposed within a cavity of the body.

10. The lighting apparatus according to claim 1, wherein the at least four inclined reflection surfaces are inclined with reflection angles which are different from each other with respect to a horizontal straight line.

11. The lighting apparatus according to claim 10, wherein the reflection angles which are different from each other gradually decrease in a direction farther from the light emitting diodes.

12. The lighting apparatus according to claim 1, wherein the inclined reflection surfaces have a spherical surface or an aspheric surface.

13. The lighting apparatus according to claim 1, wherein a straight line distance between the light emitting diodes and the transparent sheet is longer than that of the light emitting diodes and the first reflection surface.

14. The lighting apparatus according to claim 1, wherein the first reflection sheet includes a regular reflection sheet, wherein the second reflection sheet includes a diffused reflection sheet, and wherein an angle ratio between the first reflection sheet and the second reflection sheet which is disposed at a region between an optical axis and a first axis orthogonal to the optical axis from the light emitting diodes a starting point has a range of 6.5:2.5 to 7.5:1.5.

15. The lighting apparatus according to claim 1, wherein the first reflection portion of the heat radiation body includes a spherical surface and a plurality of inclined surfaces in a contact region of the first reflection sheet.

16. A lighting apparatus comprising:

a housing including a first back cover and a second back cover which are disposed on both sides of a center thereof and have an inner surface with a parabolic shape and recesses which are opened under the first and second back covers;

a first light emitting module including a plurality of first light emitting diodes for emitting light to a first recess of the recesses of the first back cover and a first circuit board on which the first light emitting diodes are disposed;

a second light emitting module including a plurality of second light emitting diodes for emitting light to a second recess of the recesses of the second back cover and a second circuit board on which the second light emitting diodes are disposed;

a heat radiation body disposed under center regions of the first and second back covers and including a plurality of heat radiation portions on which the first and second circuit boards of the first and second light emitting modules are disposed and a plurality of reflection portions which extends along a contour line of an inner spherical surfaces of the first and second back covers from each of the heat radiation portions;

a plurality of transparent sheets disposed in an oblique direction between an upper portion of each of the recesses of the first and second back covers and a lower portion of the heat radiation body;

a first reflection sheet disposed on each of the reflection portions and reflecting a first side light emitted from the first and second light emitting diodes to the transparent sheet; and a second reflection sheets disposed on inner surfaces of the first and second back covers and reflecting a main light emitted from the first and second light emitting diodes to the transparent sheet, wherein the first reflection sheet has a plurality of reflection surfaces, wherein the first and second back covers have a symmetrical shape about a center line, wherein a lower portion of the transparent sheet is disposed at the lower portion of the heat radiation body, wherein the lower portion of the transparent sheet is disposed closer to the light emitting diodes than an upper portion of the heat radiation body, wherein the plurality of reflection surfaces includes a first reflection surface which is adjacent to the first and second light emitting diodes and at least four inclined reflection surfaces which are bent at a plurality of stages from the first reflection surface, wherein a straight line distance between the first and second light emitting diodes and the transparent sheet is longer than that of the first and second light emitting diodes and the first reflection surface, and wherein the second reflection sheet is disposed on a region between each of the transparent sheets and the first reflection sheet.

17. The lighting apparatus according to claim 16, wherein the plurality of transparent sheets includes a diffusion sheet, wherein the first reflection sheet includes a regular reflection material, and wherein the second reflection sheet includes a diffused reflection material.

18. The lighting apparatus according to claim 17, wherein the plurality of transparent sheets and the first and second light emitting diodes are inclined in a different angle from each other to a horizontal straight line, and wherein each of the plurality of transparent sheets are not arranged to face to light emitting surfaces of the first and second light emitting modules.

19. A lighting apparatus comprising:

a housing including a first back cover whose inner surface has a parabolic shape and including a recess opened under the first back cover;

a first light emitting module including a circuit board and a plurality of light emitting diodes which are arranged on the circuit board;

a heat radiation body disposed in one region of the first back cover, the heat radiation body including a first heat radiation portion in which the circuit board is disposed and a first reflection portion which extends from the first heat radiation portion along a contour line of an inner spherical surface of the first back cover;

a transparent sheet disposed in an oblique direction between an upper portion of the recess of the first back cover and a lower portion of the heat radiation body;

a first reflection sheet disposed on the heat radiation body and reflecting a first side light emitted from the plurality of light emitting diodes to the transparent sheet; and a second reflection sheet disposed on an inner surface of the first back cover and reflecting a main light emitted from the plurality of light emitting diodes to the transparent sheet, wherein the first reflection sheet includes a plurality of reflection surfaces, wherein a lower portion of the transparent sheet is disposed at the lower portion of the heat radiation body, wherein the lower portion of the transparent sheet is disposed closer to the light emitting diodes than an upper portion of the heat radiation body, wherein the first reflection sheet includes a regular reflection sheet, wherein the second reflection sheet includes a diffused reflection sheet, and wherein an angle ratio between the first reflection sheet and the second reflection sheet which is disposed at a region between an optical axis and a first axis orthogonal to the optical axis from the light emitting diodes as a starting point has a range of 6.5:2.5 to 7.5:1.5.

* * * * *